US006365856B1

(12) United States Patent
Whitelaw

(10) Patent No.: US 6,365,856 B1
(45) Date of Patent: Apr. 2, 2002

(54) PARTICLE SEPARATOR AND METHOD OF SEPARATING PARTICLES

(76) Inventor: William Whitelaw, 2 Cypress St., Framingham, MA (US) 01702

( * ) Notice: Subject to any disclaimer, the term of this patent is extended or adjusted under 35 U.S.C. 154(b) by 0 days.

(21) Appl. No.: 09/421,474

(22) Filed: Oct. 19, 1999

Related U.S. Application Data

(60) Provisional application No. 60/105,030, filed on Oct. 20, 1998.

(51) Int. Cl.[7] ..... B03C 7/00

(52) U.S. Cl. ..... 209/127.1; 209/128; 209/129; 209/130

(58) Field of Search ..... 209/127.1, 128, 209/129, 130

(56) References Cited

U.S. PATENT DOCUMENTS

| | | | | |
|---|---|---|---|---|
| 4,144,163 A | | 3/1979 | Kolm | 209/12 |
| 4,194,971 A | | 3/1980 | Beeckmans | 209/467 |
| 4,274,947 A | | 6/1981 | Beeckmans et al. | 209/12 |
| 4,325,820 A | | 4/1982 | Whitlock | 209/127 R |
| 4,326,951 A | * | 4/1982 | Broz | 209/127 R |
| 4,374,727 A | | 2/1983 | Takahashi et al. | 209/127 B |
| 4,627,579 A | | 12/1986 | Rich | 241/79.1 |
| 4,839,032 A | | 6/1989 | Whitlock | 209/3 |
| 4,874,507 A | | 10/1989 | Whitlock | 209/11 |
| 4,935,122 A | | 6/1990 | Dreyfuss | 209/39 |
| 4,941,969 A | | 7/1990 | Schönert et al. | 209/39 |
| 5,060,871 A | | 10/1991 | Brassinga et al. | 241/24 |
| 5,224,604 A | | 7/1993 | Duczmal et al. | 209/12 |
| 5,454,472 A | | 10/1995 | Benecke et al. | 209/127.1 |
| 5,484,061 A | | 1/1996 | Dunn | 209/127.4 |
| 5,570,789 A | | 11/1996 | Dunn | 209/12.2 |

FOREIGN PATENT DOCUMENTS

| | | |
|---|---|---|
| DE | 196 53 011 | 6/1998 |
| WO | WO 87/07532 | 12/1987 |

OTHER PUBLICATIONS

Schönert, K. et al. "Charge distribution and state of agglomeration after tribocharging fine particulate materials" *Powder Technol.* 86(1):41–47 (1996).

* cited by examiner

*Primary Examiner*—Donald P. Walsh
*Assistant Examiner*—Jonathan R. Miller
(74) *Attorney, Agent, or Firm*—Lahive & Cockfield, LLP

(57) ABSTRACT

The invention relates to a particle separator and methods for separating the particles of a mixture. The apparatus of the invention employs two field elements to create a field in the space between the field elements. The surface contact of the particles of the mixture, inputted into the space between the field elements, triboelectrically charges the particles. Under the influence of the field, the charged particles substantially aggregate on one of two counter-rotating agitators, disposed operably in the space between the field elements, according to their respective polarities. The rotation of the agitators brings the charged particles into a substantially field-free space in the vicinity of the output ports. Some of the charged particles leave the agitators under the influence of external forces to enter one of the output ports based on their charge polarities.

53 Claims, 20 Drawing Sheets

FIG. 13
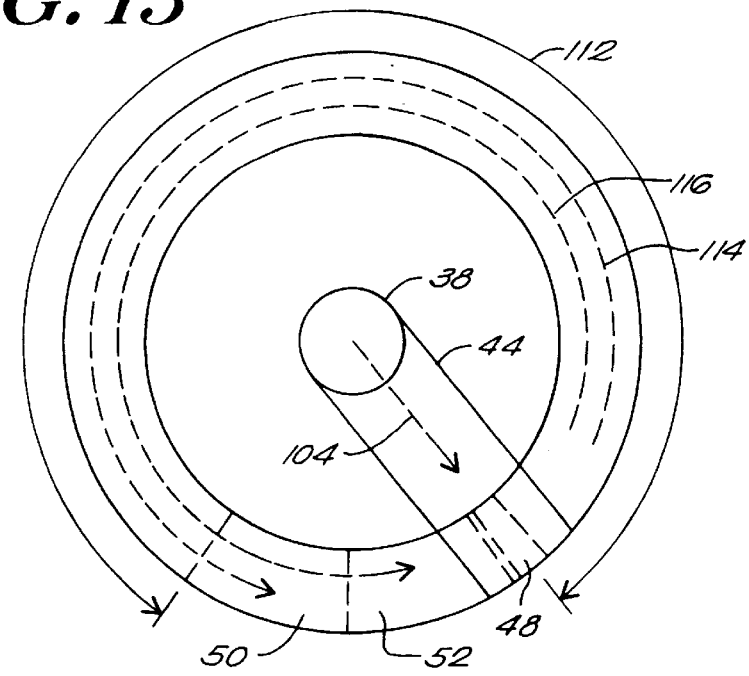
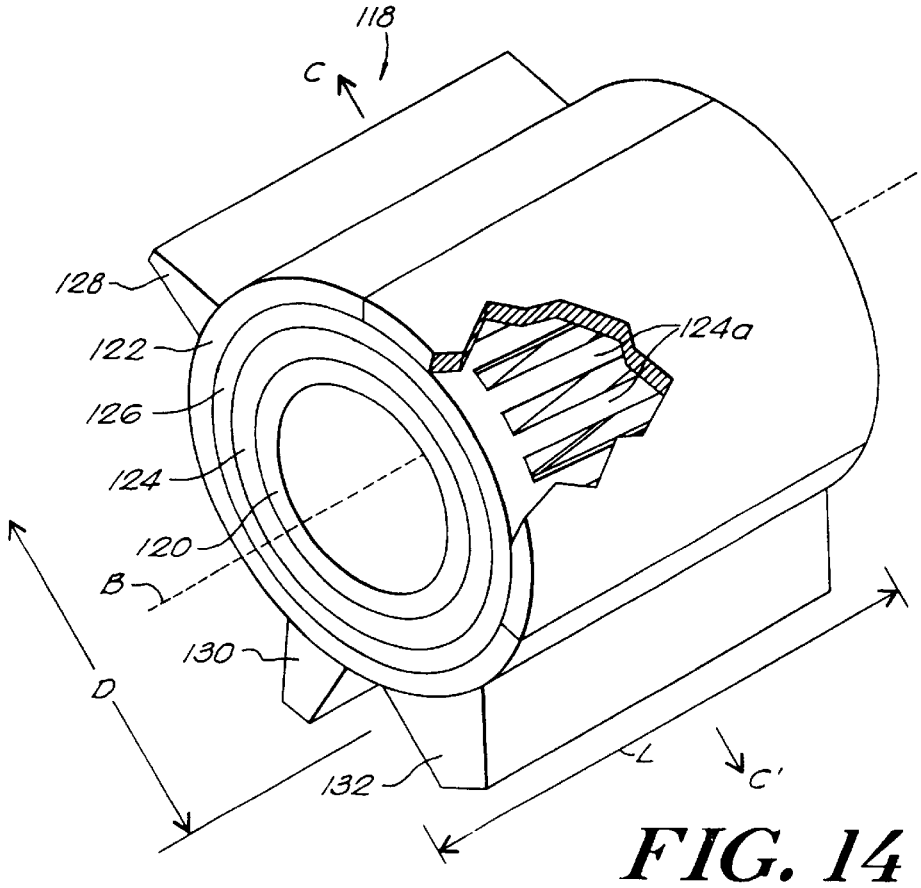
FIG. 14

PARTICLE SEPARATOR AND METHOD OF SEPARATING PARTICLES

RELATED APPLICATIONS

This application claims priority to the provisional application filed Oct. 20, 1998 and having Ser. No. 60/105,030.

BACKGROUND

The present invention relates to apparatus and method for separating particle constituents of a mixture. In particular, the invention relates to triboelectrically charging the particles and separating them under the influence of a field.

There is a need for separating various constituents of a mixture in many technological and scientific fields. For example, sulfur-bearing constituents of coal reduce its burning efficiency, and also contribute to the pollution of the environment. Thus, it is desirable to remove such sulfur-containing constituents from pulverized coal. There is a similar need for separation processes to recover phosphate rock from phosphate ores which are mined in a matrix that includes a mixture of phosphate rock and silica in a clay-like material known as "slimes." Separation processes can also be profitably utilized in separating various constituents of a frozen aqueous solution. Such separation processes for liquids find applications in preparation of concentrate foods. For example, removal of ice crystals from a frozen fruit juice concentrates the fruit juice.

A number of electrostatic separators are known in the art. For example, U.S. Pat. No. 4,274,947 describes a separator that includes an elongated enclosure in which a mixture of particles are triboelectrically charged by mechanical agitation and the motions induced by air flow in a fluidized bed. An electrical potential applied to a horizontal electrode above the mixture and the grounded base of the enclosure establish an electric field within the enclosure, which by differential attraction of the charged particles, induces vertical migration and stratification of the charged particles. Paddles attached to endless chains move the charged particles in the lowest stratum toward one end of the enclosure, and buoyant forces cause the charged particles in the upper stratum to move toward the opposed end of the enclosure. The oppositely charged particles are removed from the opposite ends of the enclosure. The stratification of the particles in this type of separator is partially determined by the sizes of the particles and their degree of buoyancy in the fluidized bed, thus restricting the types of mixtures that can be separated.

U.S. Pat. No. 4,194,971 also employs paddles and drive chains, substantially submerged in the particle stream, for moving inputted particles that have been triboelectrically charged. The paddles drive charged particles of one polarity in a lower stratum in one direction, and drive the oppositely charged particles in an upper stratum in an opposite direction, thereby producing two current flows. An intermediate shear zone separates these two current flows. In this separator, the mechanical properties of the particles, such as size, mass, and buoyancy, rather than their triboelectrically charging properties, solely determine the stratification of the charged particles, and hence their separation.

In another example, U.S. Pat. No. 4,839,032 describes an electrostatic separator that employs two electrodes having opposite voltages to create an electric field between the electrodes. A perforated dielectric sheet, placed in the space between the electrodes, provides areas that exhibit electric fields and areas that do not exhibit electric fields. Particle charging due to contact occurs in the former, and particle separation occurs in the latter. This patent asserts that an endless belt moves the particles of the mixture continuously in a direction transverse to the field to allow triboelectrically charging of the particles and separation of the particles in field-free areas. One disadvantage of this type of separator is that the belt tends to wear out quickly due to the abrasive environments in which it operates. Thus, periodic monitoring and repairing of the belt is needed. Such maintenance is time-consuming, and also adds to the operating costs. In addition, many of such separators do not provide any structures for the introduction of the mixture into the space between the electrodes at a number of different positions. Although some conventional separators include multiple input ports, the locations of the input ports of such separators are fixed, and can not be spatially varied in order to optimize the separation process.

A number of beltless electrostatic separators are also known in the art. A class of such prior art beltless electrostatic separators employ rubbing contact of the particles of a mixture with a surface, while the particles are moving at high velocities, to triboelectrically charge the particles. Such contact imparts either positive or negative charge to particular particles of the mixture depending on the charge-bearing properties of the particles. One such separator blows the particles of a mixture at high velocity through a sinuous path. The impact of the particles with the inner walls of the path results in charging of the particles. Upon leaving the sinuous path, the passage of the charged particles through a space between two charged electrodes separates the particles. The impact of the particles with the walls of the sinuous path can result in disintegration of some of the particles into smaller components. Such disintegration may not be desirable, thus limiting the number of applications of such a system for separating the particles of a mixture. Further, the impact of the particles having high velocities with various parts of such separators typically results in a rapid wear of the parts. In addition, such separators typically have a low throughput, and hence are not suitable for industrial-scale separation processes. Further, similar to the separators having belts, the beltless separators typically do not allow adjusting the locations of the input and output ports.

Further, many prior art separators for bulk processing applications employ uninsulated metallic or uninsulated conductive ceramic electrodes mainly because of difficulties in insulating high voltage electrodes, susceptibility of insulating surfaces to wear, and reduction in electric field strength in the separation region as a result of voltage drop across the insulating material. The use of uninsulated electrodes can result in a sparkover voltage between the electrodes, which can cause an electrical arc if the electrodes are not current limited, and if the high voltage power supply can sustain the required power.

Such an electrical arc causes the voltage between the positive and the negative electrodes to drop below a voltage required for particle separation. Further, such an electrical arc can cause damage to the electrodes. Many prior art separators employ current-limiting resistors, in the megaohm range or higher, connected in series with the electrodes to guard against formation of electrical arcs. Such resistors, however, do not eliminate the occurrence of a sparkover voltage. Sparkover voltages can result in formation of streamers, i.e., sustained electrical discharges in the microampere to milliampere range.

The passage of currents of such magnitudes through the current limiting resistors cause power dissipation in the range of tens to hundreds of watts, rendering safe design and construction of the resistors difficult. Further, the streamers can erode metallic portions of the separator, and can cause fires in the separation region.

Further, sparkover voltages can cause material erosion, such as erosion of conductive ceramic tiles of the electrodes employed in many electrostatic separators. Further, electrical arcs between the electrodes can potentially cause explosions when the particle mixture includes combustible or flammable materials. This leads to difficult and costly design and construction methods to guard against such explosion hazards.

Uninsulated or conductive electrodes can also lead to formation of precipitated layers of material on the electrodes when the removal mechanism fails to completely remove the material accumulated on the electrodes. Precipitated layers, formed of non-conductive materials, can disadvantageously lead to local microsparking and ion production even at applied electrode voltages that are much less than the nominal sparkover voltage. Further, the particles of precipitated layers formed of conductive materials tend to discharge into the electrode to become uncharged. These uncharged particles return to the separation stream, thus placing an upper limit on the purity of the separation process.

Accordingly, it is an object of the invention to provide a separator that provides improved particle separation while concomitantly providing increased durability and wear resistance.

It is another object of the invention to provide a separator that allows adjustment of the locations of the input ports.

It is yet another object of the invention to provide a separator that allows the electrostatic field to be varied as a function of time and spatial position.

SUMMARY OF THE INVENTION

These and other objects of the invention are attained by a separator for separating the particles of a mixture according to the teachings of the invention that employs at least two spaced-apart field element arrays to establish a field between the element arrays. The separator also includes an input for introducing the particles of the mixture into the space between the field elements. Further, two oppositely-rotating agitators, operably disposed in the space between the field elements, agitate the particles to charge them to one of two charge polarities. The charged particles move under the influence of the field such that particles of one charge polarity substantially accumulate in a region close to one field element array, and particles of opposite charge polarity substantially accumulate in a region in the proximity of the other field element array. The rotation of the agitators sweep the charged particles of opposite polarities in two different directions, and also agitate the uncharged particles to triboelectrically charge them.

According to one aspect of the invention, the separator can include output ports for collecting the separated particles. The invention configures the field element arrays and the output ports such that there is a region in the vicinity of the output ports that is substantially field free. As the agitators bring the particles into this field free region, some of the particles under the influence of external forces, such as gravity and/or centrifugal forces, leave the agitators and enter one of the output ports. Because the agitators can rotate in opposite directions, the charged particles accumulated near one agitator first encounter one output port as they enter the field-free region whereas the oppositely charged particles, accumulated near the counter-rotating agitator, first encounter another output port as they enter the field-free region. Accordingly, each output port substantially collects particles of one of two charge polarities, thus separating the particles.

In accordance with another aspect of the invention, at least one of the field element arrays includes a plurality of field generating electrodes arranged to form an annular disk. For example, one or both field element arrays can include a plurality of electrodes having narrow strips of a conductive material, such as copper, that are insulated from each other and from the opposed field element array by strips of an insulating material having a high breakdown voltage, such as a Kapton film. One practice of the invention employs a ceramic, such as alumina, to encapsulate the strips. An alternative practice of the invention encapsulates the strips by polyurethane and employs a layer of a ceramic, such as alumina, disposed on the polyurethane to provide a hard surface for the encapsulated strips. Such construction of one or both field element arrays provides some flexibility in configuring the spatial distribution of the electric field between the field element arrays. In particular, different voltages can be applied to different electrodes to effectuate a desired configuration of the electric field in the space between the field element arrays. Further, the invention can apply time-varying voltages to any number of the electrodes to produce a time-varying electric field in the space between the field element arrays.

According to one aspect of the invention, each electrode includes a mechanical substrate, to which a metallic conductor is bonded. The electrode further includes a high-voltage connector in electrical contact with the metallic conductor for application of an electrical potential to the conductor. An insulating layer covers the metallic conductor to electrically insulate the electrode, and a wear strip covers the insulating layer to provide mechanical protection. One preferred practice of the invention encloses the electrode partially with a conductor to provide a ground plate, and optionally employs non-conducting inserts to provide tie points for attaching selected mechanical structures to the electrode.

According to another aspect of the present invention, the separator can employ agitators in the form of two annular disks of non-conducting material that are operably disposed in the space between the electrodes, preferably co-axially with the two electrodes. A variety of non-conducting materials, such as plastic, ceramic, industrial glasses, or plastic-ceramic composites, can be employed to construct the agitators. In particular, ceramic materials having sufficient surface hardness, breakdown voltage, and temperature resistance are suitable for construction of the agitators. The annular disks preferably possess a common axis of rotation and have a number of openings therein to allow the passage of the particles of the mixture therethrough.

According to a further aspect of the present invention, the separator can include an input that is formed in one of the field element arrays to introduce the particles of the mixture into the space between the field element arrays. For example, an opening in the solid portion of one of the annular field elements can provide the input port for introducing the particles of a mixture into the separator. The input port is preferably adjustable so that the particles can be introduced into the space between the field element arrays at a number of different locations. In particular, it is preferable that the position of the input port can be varied continuously and in real-time while the separator is operating.

During operation of the separator, the inputted particles collide with the agitators and with each other and become triboelectrically charged to one of two polarities. The electrostatic field between the field element arrays exerts a force in the direction of the field on the positively charged particles, and exerts a force in the opposite direction on the negatively charged particles. Thus, the positively charged and negatively charged particles drift in opposite directions, and accumulate substantially in regions close to the field element arrays. For example, the positively charged particles substantially accumulate in the proximity of the negative field element array, and the negatively charged particles substantially accumulate in the proximity of the positively charged field element array.

In accordance with an alternative embodiment of the invention, the separator employs two spaced-apart cylindrical field element arrays, one disposed within the other, to establish a field in the space between the two cylinders. The cylindrical field element arrays are preferably co-axial, and can be constructed in a number of different ways. For example, one or both field element arrays can be formed of a plurality of field generating electrodes, having strips of conductive material such as copper, arranged to create a cylindrical or semi-cylindrical surface, and are electrically insulated from each other and the outside environment by an insulating material having a high breakdown voltage, such as Kapton film. Alternatively, the field element arrays can be constructed by utilizing a conductive material that is shaped into a cylindrical or a semi-cylindrical surface.

In one practice of the invention, time-varying electrical potentials are applied to the field element arrays to produce a time-varying electric field in the space between the field element arrays. For example, a temporary reversal of the polarity of the electric field between the field element arrays can reduce accumulation of material on the surfaces of one or both of the field element arrays. Further, a change in the magnitude and/or polarity of the electric field at selected locations in the space between the field element arrays can stimulate additional mixing of the particles which in turn can enhance the purity and/or the yield of the separation process. Such enhancements can allow construction of a separator with shorter separation zones having a performance comparable with a larger separator.

One aspect of the invention relates to providing easy access to various components of a separator for their replacement and/or repair. For example, one embodiment of a cylindrical separator according to the invention constructs the outer cylindrical field element array by connecting two semi-cylindrical segments together. One such connection can be a hinge that allows rotation of one semi-cylindrical segment with respect to the other to provide access to the agitators and the inner field element array disposed within the outer field element array. In addition, the invention can construct the agitators in a similar manner to provide easy access to various components of the separator.

In another aspect, the present invention provides a separator that includes two spaced-apart annular field element arrays for establishing an electric field in the space between the arrays. Further, the separator includes an input port for introducing the particles of the mixture into the space between the arrays. Two spaced-apart annular agitators, configured to rotate in the same direction, agitate the particles of the mixture, to triboelectrically charge them to one of two charge polarities. The agitators include openings therein to allow passage of the particles of the mixture. The separator further includes two output ports, and includes a plate disposed in the space between the agitators extending substantially over one of the input ports. The plate prevents entry of charge particles having one polarity into the output port over which it extends. Hence, the charged particles of one polarity enter one of the output ports, and those having an opposite polarity enter the other output port.

Another aspect of the invention relates to providing a separator that includes two annular spaced-apart field element arrays for establishing a field in the space between the arrays. The separator further includes an input port for introducing the particle mixture into the space between the arrays. Two agitators are disposed in the space between the field element arrays and are configured for rotation. Each agitator includes a ring from which a plurality of impellers are cantilevered. The impellers triboelectrically charge the particles into two charge polarities, where particles having one charge polarity substantially accumulate in the vicinity of one of the field element arrays, and the particles having the opposite charge polarity substantially accumulate in the vicinity of the other field element array.

BRIEF DESCRIPTION OF THE DRAWINGS

These and other features and advantages of the present invention will be more fully understood by reference to the following detailed description in conjunction with the attached drawings in which like reference numerals refer to like elements through the different views. The drawings illustrate principals of the invention, and although generally or occasionally not to scale, may show relative dimensions.

FIG. 13 is a top view of a separator according to the teachings of the present invention configured for co-current operation (agitators not shown for clarity) with the input port located at a maximal distance from one of the output ports, illustrating schematically the paths of the charged particles from the input port to the output ports;

FIG. 14 is a perspective view of a cylindrical separator according to the teachings of the invention, including two cylindrical field element arrays, one placed within the other, and two cylindrical agitators disposed in the space between the field element arrays;

DETAILED DESCRIPTION

Figure 1:
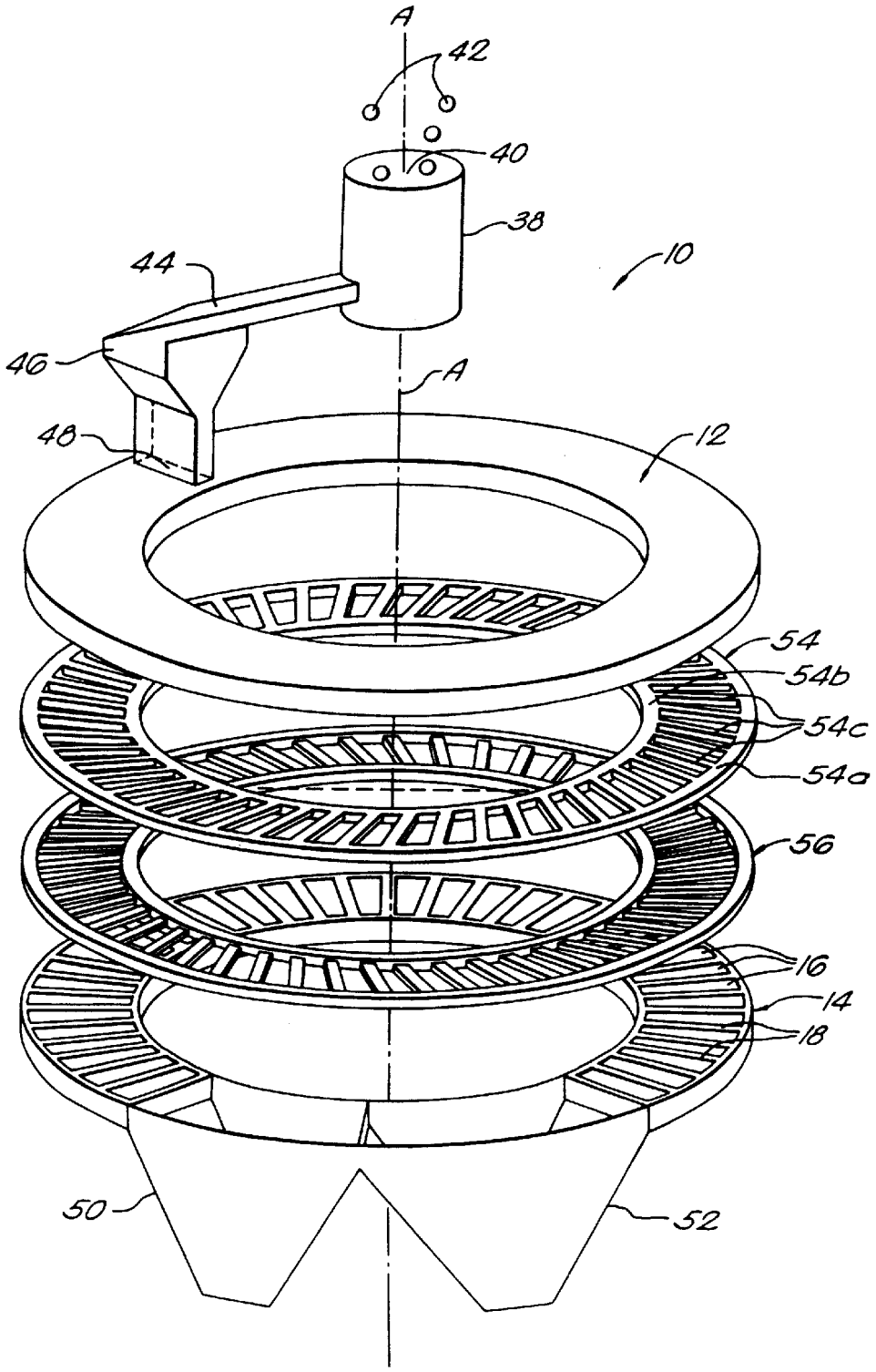
FIG. 1 is an exploded, unassembled view of a separator according to the teachings of the invention, including two annular field elements and two annular agitators.
Figure 2:
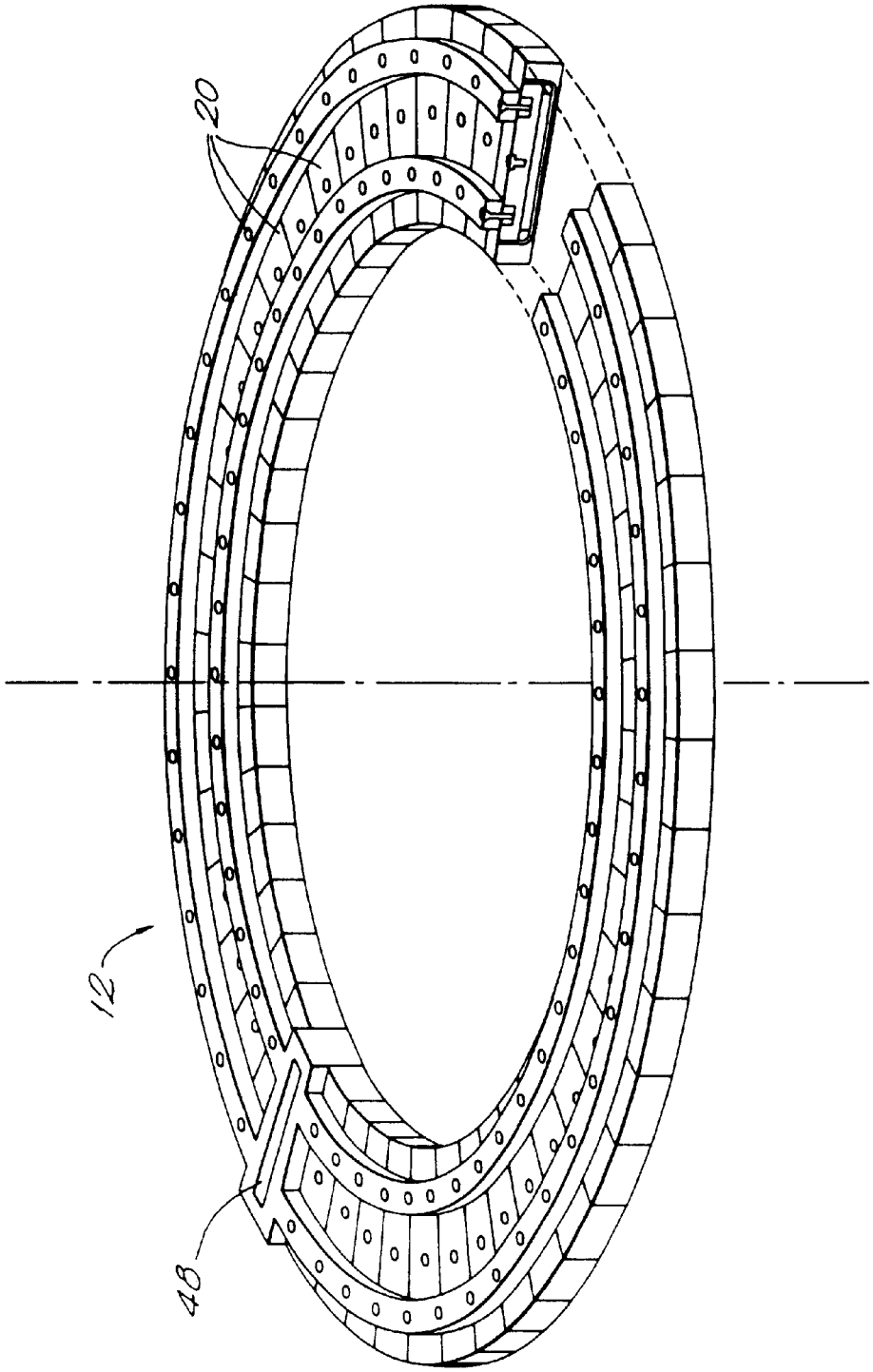
FIG. 2 is a perspective view of a plurality of electrodes forming the upper field element array of the separator of the previous figure.

A first illustrative embodiment of a separator 10 according to the present invention, as shown in FIG. 1, includes an array of field elements 12, held at a selected high electric potential, and another array of field elements 14, held at a different electric potential, so as to establish an electric field in the space between the field element arrays 12 and 14. The field element arrays 12 and 14 are two annular disks that are co-axially positioned with respect to each other. The field element array 14 includes a plurality of field generating elements, or electrodes, 16 insulated from each other and from the outside environment by strips 18 of insulating material having a high breakdown voltage, such as a Kapton film. FIG. 2 shows that the field element array 12 includes a plurality of electrodes 20 similar to the electrodes 16. Employing a number of field generating elements 16 and 20 to form field element arrays 12, and 14 provides some flexibility in configuring the spatial distribution of the electric field between the field element arrays 12 and 14. In particular, different voltages can be applied to independent electrodes 16and 20 or selected groups of these electrodes to effectuate a desired configuration of the electric field in the space between the field element arrays 12 and 14. The present construction of the field element arrays 12 and 14 also allows application of positive voltages to a selected number of the field generating elements 16 and 20 forming one of the field element arrays 12, 14 while holding the remaining field generating elements of the field element array at negative voltages, or vice versa. The field generating elements 16 and 20 can be optionally encapsulated by a protective layer of ceramic, such as alumina. Alternatively, the field generating elements 16 and 20 can be encapsulated by polyurethane upon which the layer of ceramic is disposed.

Figure 3:
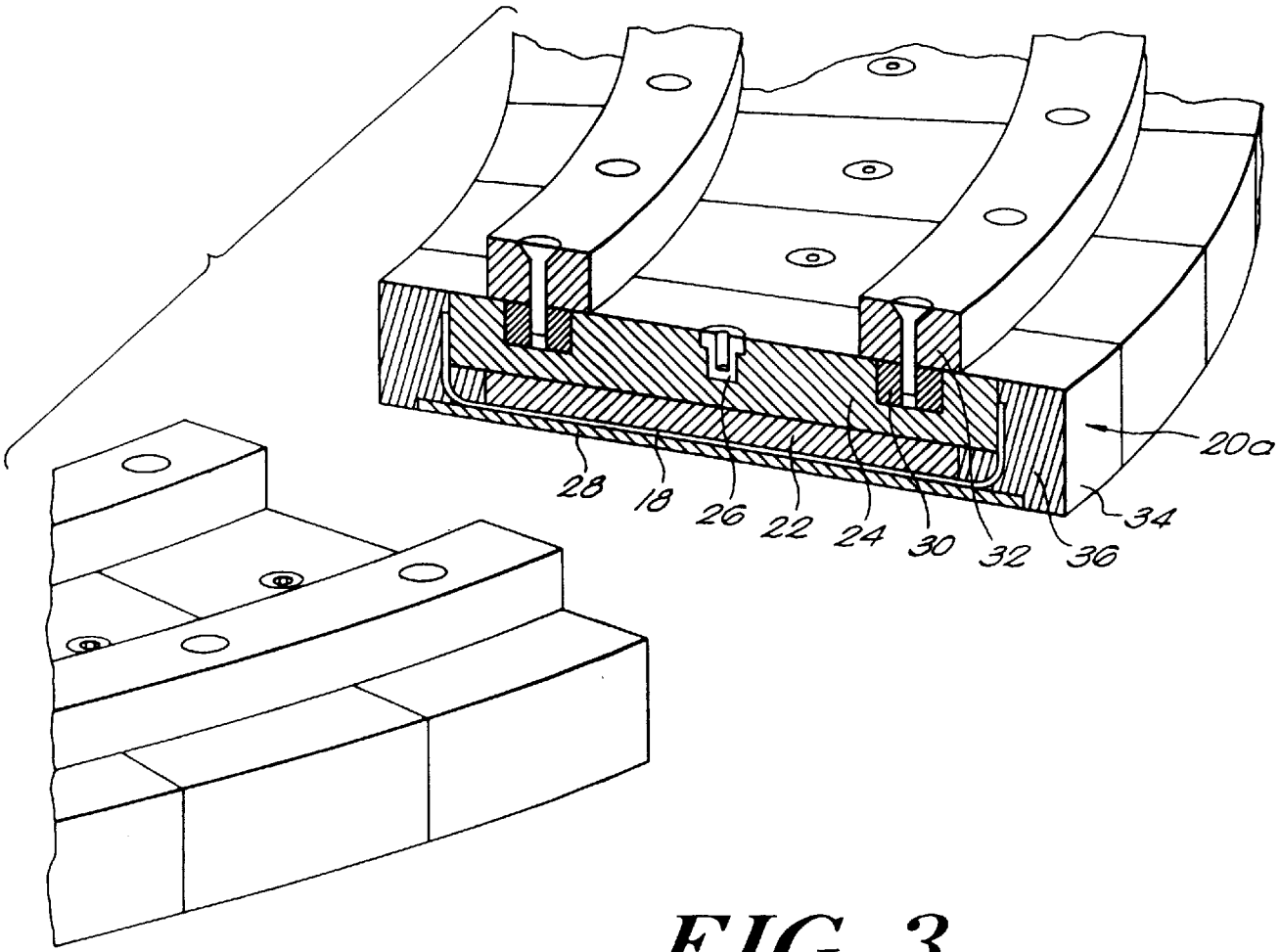
FIG. 3 is a perspective view of the components of one of the electrodes shown in FIG. 2.

FIG. 3 illustrates a cross-sectional view of an electrode 20*a* that is one of the plurality of electrodes 20 forming the field element array 12. A conductor 22 formed for example of copper, bonded to a mechanical substrate 24, forms the electrically active portion of the electrode 20*a*. The conductor 22 can be formed of other materials, such as graphite. The conductor 22 is internally wired to a high-voltage connector 26 that allows application of a high electric potential to the electrode 20*a*. Further, a layer of a dielectric film 18, such as Kapton, insulates the conductor 22. Thus, the dielectric film 18 insulates the conductive portion of the electrode 20*a* from the particle stream and from its neighboring electrodes in the field element array 12. A wear strip 28, formed preferably of a hard and abrasion-resistant material, such as alumina, provides mechanical protection for the insulating film. The mechanical substrate 24 can be preferably formed of a block of structural foam, to provide structural support for the electrode 20*a*. Threaded non-metallic and non-conductive inserts 30, bonded to the substrate 24, provide tie points at which the electrode 20*a* can be attached to other structural elements, such as the illustrated circular beams 32. A metallic conductor 34 partially encloses the electrode 20*a* and establishes a ground plate. The entire electrode 20*a* is potted in a solid adhesive material 36, such as polyurethane.

The conductor 22, to which an electrical potential is applied, is advantageously both mechanically and electrically insulated from the particle mixture and the other field generating electrodes. Thus, the electrical potential applied to the conductor 22 is independent of the electrical potentials applied to the other electrodes. The electrical insulation of the electrodes 20 advantageously allows a considerable variation and control of the resulting electric field, which is a superposition of the electric fields generated by each individual electrode.

Referring again to FIG. 1, the voltages applied to the field elements 12, and 14 can be static, or can be time-varying. The polarity of the static voltage applied to each of the field elements 12, and 14 can be either positive or negative. The application of a time-varying voltage to one or both of the field element arrays 12, 14 results in establishing a time-varying electric field in the space between the field elements 12, 14. Such a time-varying electric field can be, for example, utilized to decrease the amount of material accumulated on one or both of the field element arrays 12 and 14. In addition, the ability to vary the electric field in the space between the field element arrays 12, 14 as a function of time can be useful in cases where the location of the input of the particles of the mixture into the separator is temporally varied.

The separator 10 includes an input ducting 38 having an opening 40 that receives the particles 42 of a mixture. The input ducting 38 further includes an airslide 44 of conventional type, and a duct 46 that is connected to an input port 48. The input port 40 is formed in the field element array 12 as an opening in the solid portion of the annular disk. The particles 42 move through the duct 38 under the influence of gravity and/or the pressure of an inert gas flowing through the input to be introduced into the space between the field element arrays 12 and 14. The field element array 12 is configured to be rotatable about a rotation axis A. Thus, the input port 48 is also movable about the same axis. One practice of the invention employs a motor drive, connected to the field element array 12, to rotate the field element array 12, and consequently the input port 48, about the rotation axis A. Alternatively, the field element array 12 can be moved manually about the rotation axis A. Accordingly, the particles 42 can be introduced through the input port 48 into the space between the field element arrays 12 and 14 at a number of different locations.

One preferred embodiment of the invention supports the field element arrays 12 and 14 in a frame (not shown) formed, for example, of welded steel tubes. The field element array 12 having the input port 48 can be supported within the frame at its outer edges by bearings, rollers, or wheels, that allow rotation of the field element array 12, and consequently rotation of the input port 48, about the rotation axis A. The bearings are in turn attached to the frame. The field element array 12 having output ports 50 and 52 can be, however, fixedly mounted to the frame.

Two agitators 54 and 56 are operably disposed in the space between the field element arrays 12 and 14. The agitators 54 and 56 are preferably positioned co-axially with respect to each other, and also with respect to the field element arrays 12 and 14. For counter-current separation, the agitators 54 and 56 can be configured to rotate in opposite directions, typically at a rate of 30–90 revolutions per minute, to mix the particles of the mixture, and thereby triboelectrically charge them to one of two polarities, and in combination with the field generated by the field element arrays 12 and 14, separate the charged particles. The agitators 54 and 56 can have the same or different rates of rotation. Alternatively, for co-current separation, the agitators 54 and 56 can be configured to rotate in the same direction. For co-current separation, the agitators 54 and 56 have typically different rotational speeds. Agitators 54 and 56 provide the advantage of being wear-resistant and durable, and hence require minimal maintenance compared with conventional endless belt-type separators.

Each agitator of the invention includes one or more structural elements. For example, the illustrated agitator 54 includes an inner ring member 54*a* and an outer ring member 54*b*. Further, the agitator 54 includes a plurality of transverse members 54*c* that are disposed substantially radially between the ring member 54*a* and 54*b*. The ring members 54*a* and 54*b* not only provide structural support, but they also allow supporting the agitator 54 by bearings, rollers or the like. Such bearings or rollers allow the agitators 54 to be driven by conventional mechanisms, such as drive belts, gear teeth, or capstan drives and idler wheels. The agitator 56 is structurally similar to the agitator 54. Additionally, mechanical seals can be affixed to the agitators 54 and 56 to seal the particle stream inside the separator.

The transverse members 54*c* an be formed of a variety of materials or of a composite of such materials. A material suitable for forming the transverse member 54*c* has an adequate mechanical strength to withstand the forces exerted on the transverse members 54*c* as they move through the particle stream, and is resistance to abrasion. Further, such a suitable material has a limited conductivity, which results in lowering the electrical field locally to reduce arcing, and further results in lessening accumulation of static charges. In addition, such a suitable material is not susceptible to damage as a result of exposure to strong electric fields. The present invention preferably employs various laminates of ceramics, industrial glasses, and/or plastics for forming the transverse members 54*c*.

In an alternative embodiment, a conductive material can form a portion of one or both agitators 54 and 56. The field strength adjacent to such conducting portions is reduced, thus lowering the possibility of a voltage breakdown of the insulating material in the field elements 12, 14.

While the separator of the illustrative embodiment is described as including two agitators 54 and 56, additional agitators can be provided to further triboelectrically charge and separate the particles of a mixture.

Figure 4:
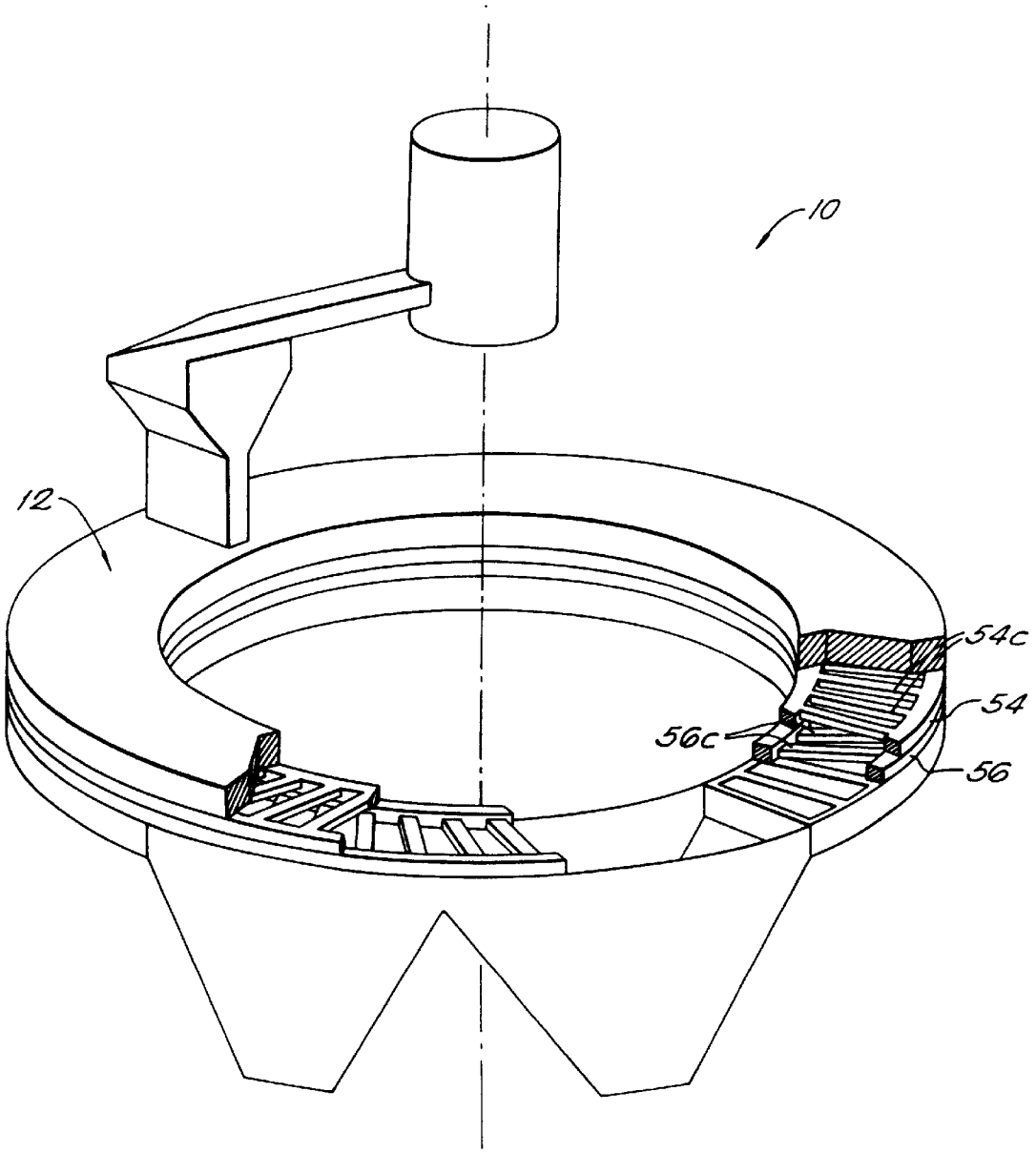
FIG. 4 is a perspective view of the separator of FIG. 1 after assembly of the field element arrays and the agitators.

FIG. 4 illustrates the various components of the separator 10 assembled in their normal operating locations. The upper field element array 12 and the two agitators 54 and 56 are shown partially sectioned in order to more clearly illustrate their structural interrelationship. FIG. 4 also shows that the transverse members 54*c* and 56*c* are somewhat skewed from a straight radial orientation. The function of such a deviation from a radial direction is two fold. First, it prevents formation of pressure pulses within the separator 10 as the transverse members 54*c* and 56*c* pass over each other as the agitators 54 and 56 rotate. Further, such a deviation imparts an inward radial momentum to the air within the separator 10, which helps counterbalance the pressure gradient formed in the circulating air by centrifugal acceleration. In an alternative embodiment, different pitch spacings are employed for the transverse members 54*c* and 56*c* to achieve similar results.

The transverse members 54*c* and 56*c* charge the particles inputted into the separator, separate the particles, and convey the separated particles as two substantially independent streams to the respective output ports, as discussed below. Thus, the transverse members 54*c* and 56*c* serve to both agitate and to transport or impel the particle mixture. In particular, the transverse members 54*c* and 56*c* agitate the particle stream to charge the particles triboelectrically. Once the particles are charged, the electric fields generated by the field element arrays 12,14 substantially stratify the particles. The agitators 54*c* and 56*c* impel the stratified particles in one direction or the other, either directly through contact of the particles or through moving the air in which the particles are entrained.

Referring again to FIG. 1, the two output ports 500 and 52 are formed in the field element array 14 by providing openings in a portion of the field element 14. The voltages applied to the field generating electrodes 16 and 20 forming the field element arrays 12 and 14 can be selected such that there is a substantially field-free region in the vicinity of the output ports 50 and 52.

Figure 5:
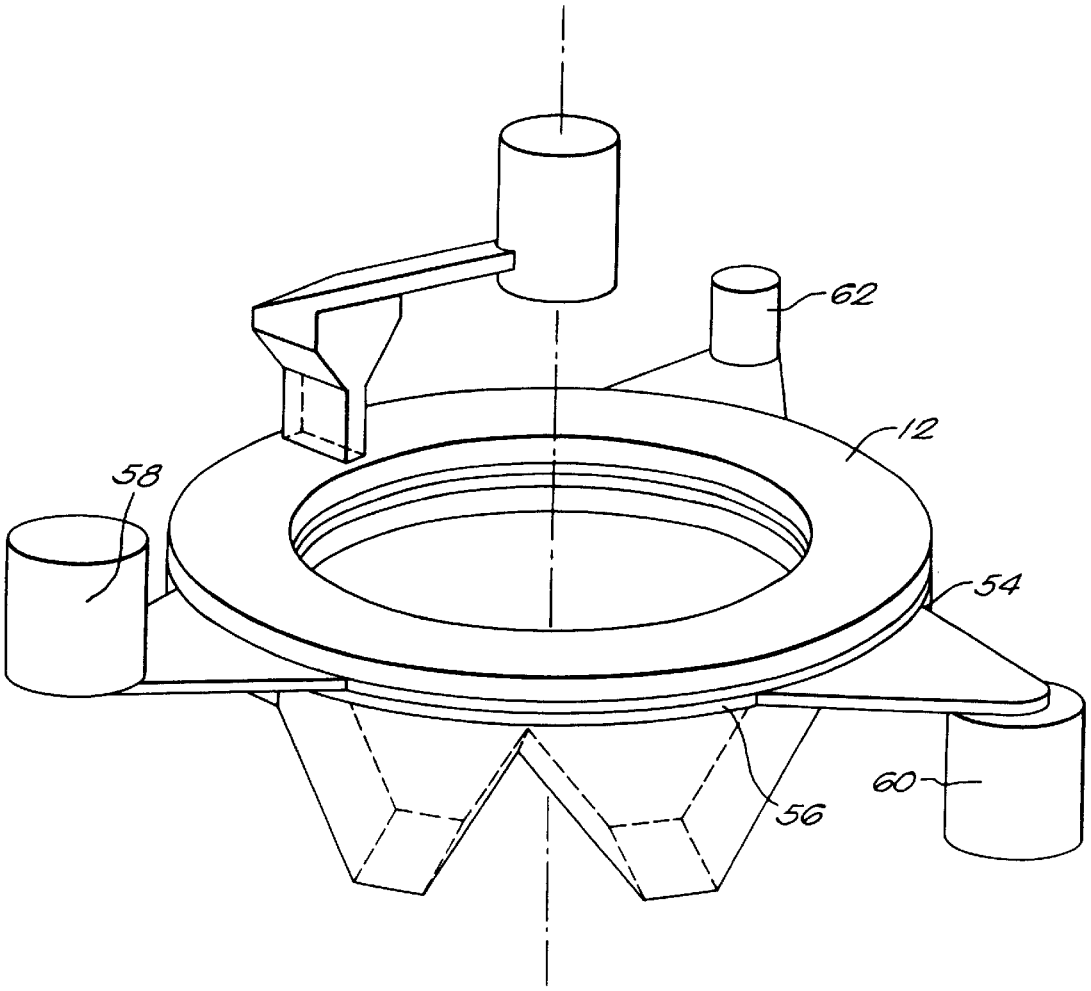
FIG. 5 is another view of the separator of FIG. 4, further illustrating a plurality of drive motors for rotating the upper field element array and the two agitators.

FIG. 5 illustrates external drive motors for rotating the agitators 54 and 56, and the upper field element array 12. In particular, in this illustrated embodiment, drive motors 58, 60, and 62 drive the upper agitator 54, the lower agitator 56, and the upper field element array 12, respectively. The drive motors 58, 60, and 62 can be of conventional types, and can be electrical, hydraulic, or pneumatic. Further, some alternative embodiments of the invention replace the drive motor 62 with a hand-crank mechanism. The illustrated drive motors 58 and 60 drive the agitators 54 and 56 from their outer edges. Those skilled in the art will understand that it is also possible to drive the agitators 54 and 56 from their inner edges, or from both their inner and outer edges, depending on the mechanical requirements of the agitator assembly in a particular circumstance.

Figure 6:
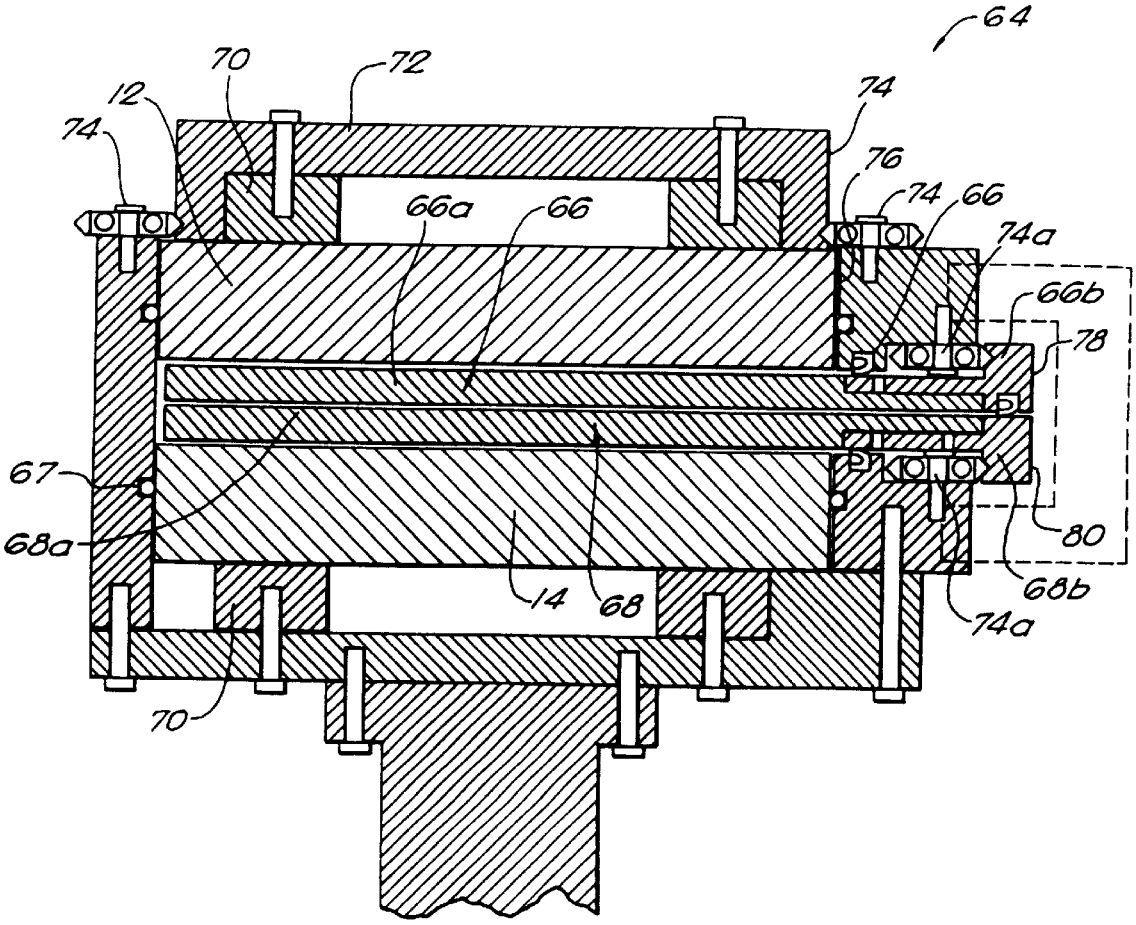
FIG. 6 is a cross-sectional view of an alternative embodiment of a separator according to the teachings of the present invention which includes two agitators, each having one ring from which a plurality of impellers are cantilevered.

FIG. 6 illustrates a separator 64 according to an alternative embodiment of the invention that includes an upper field element array 12, a lower field element array 14, an upper agitator assembly 66, and a lower agitator assembly 68. The upper agitator assembly 66 includes an impeller 66*a,* and the lower agitator assembly 68 includes an impeller 68*a*. The upper field element array 12 is mechanically fastened to rails 70, which are in turn attached to a frame 72 of the separator 64. Further, carriage bearings 74 support the field element array 12 such that it can be rotated, for example from its edge 76 in a conventional manner. The lower field element array 14 is mechanically fastened to rails 70, and is fixedly attached to the frame 72. Both the upper and the lower field element arrays 12 and 14 can be formed of a plurality of electrodes in a manner described above in connection with the previous embodiment. Whereas the agitators of the previous embodiment include two rings, each agitator assembly 66 and 68 of this alternative embodiment includes one ring 66*b* and 68*b,* respectively, from which the plurality of impellers 66*a* and 68*a* are cantilevered. Carriage bearings 74*a* support both agitator assemblies 66 and 68 such that the agitators 66 and 68 can rotate freely. For example, the agitators 66 and 68 can be driven at edges 78 and 80, respectively, by drive belts, gear teeth, capstans, and the like.

Figure 7:
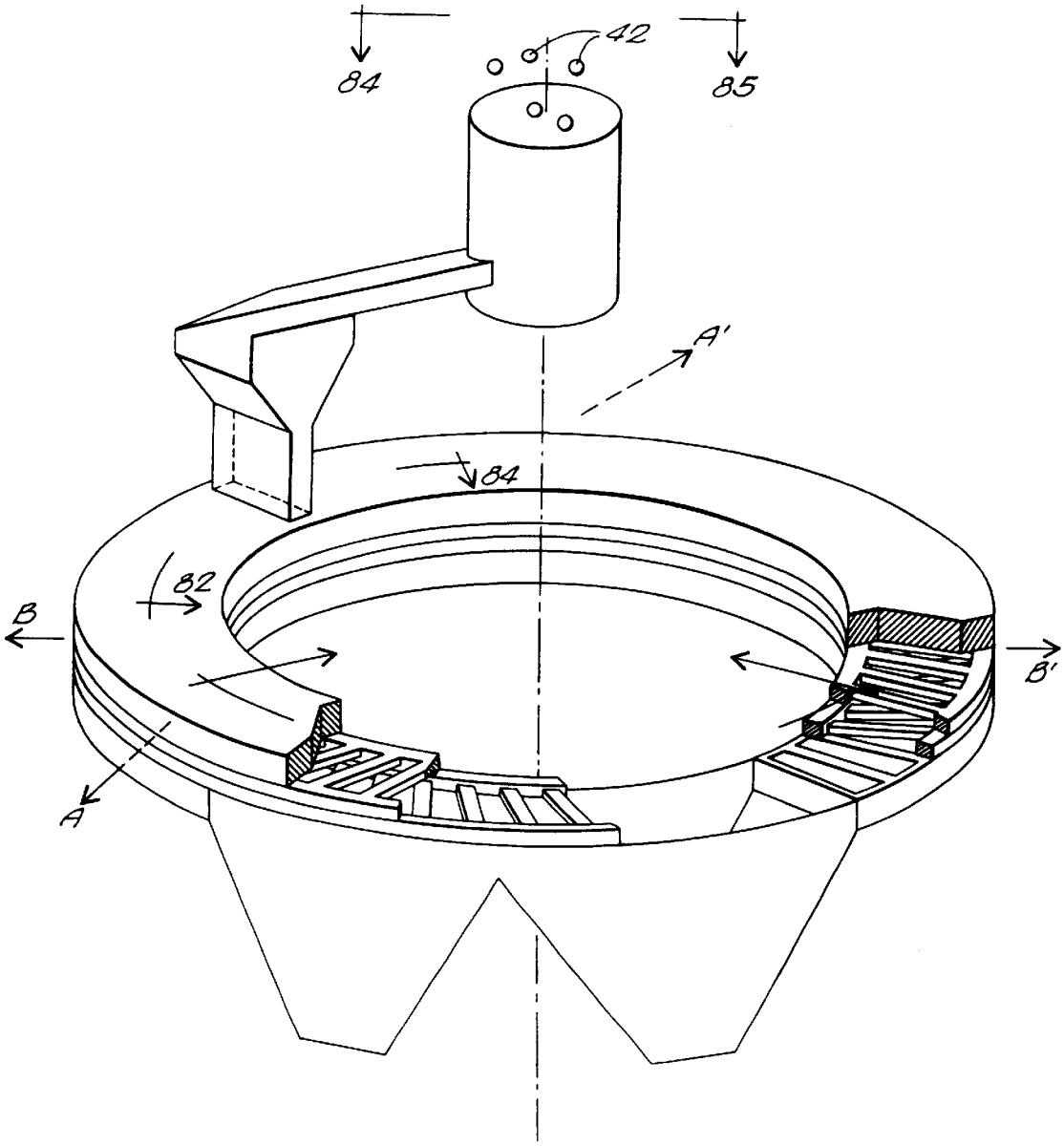
FIG. 7 illustrates introduction of a mixture of particles into the separator of FIG. 4;.
Figure 8:
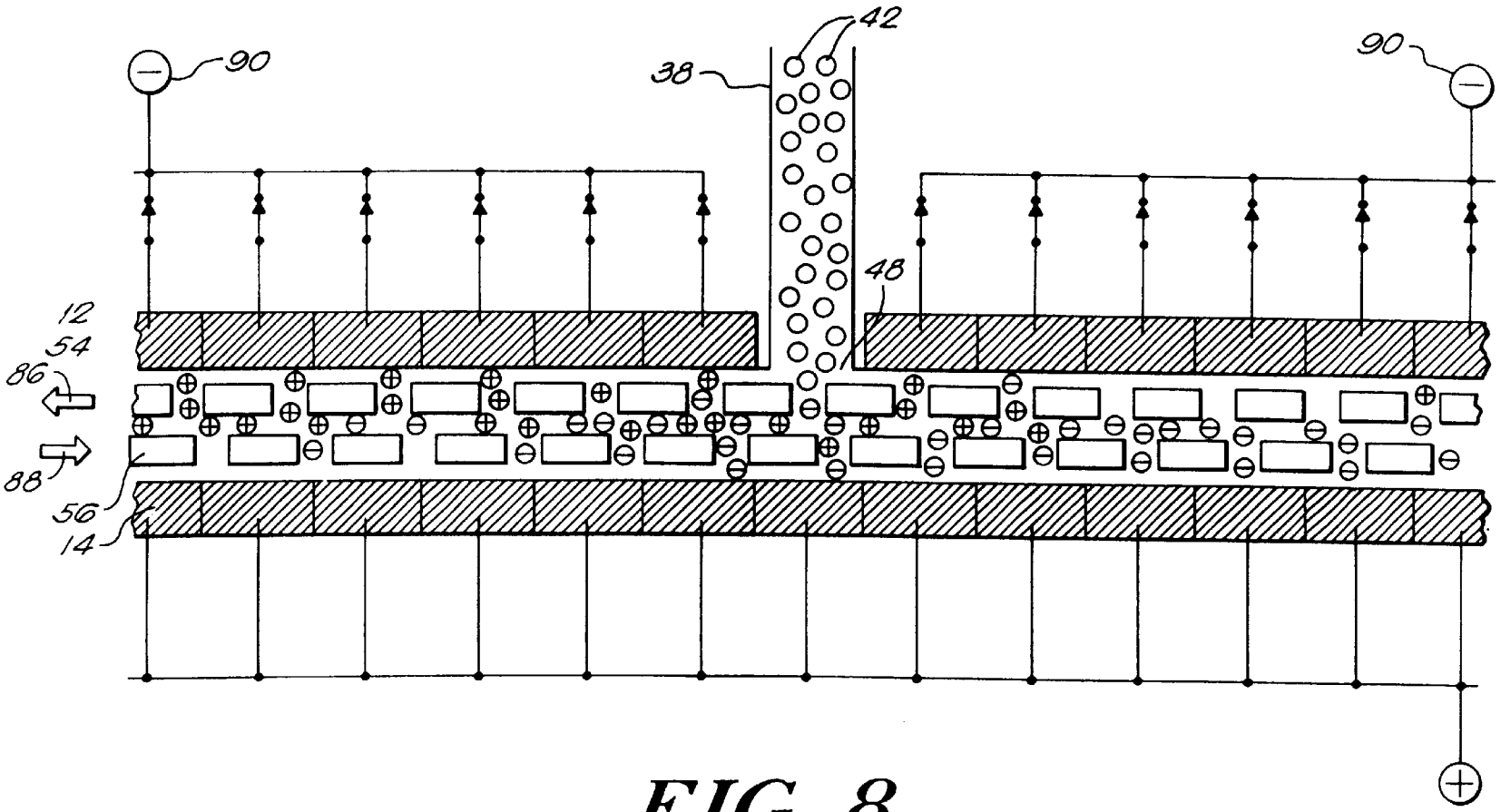
FIG. 8 is a partial cross-sectional view of the separator of FIG. 7 along the line AA' in the vicinity of the input zone, illustrating operation of the separator in a counter-current mode and stratification of the triboelectrically charged particles in the input zone. The particles are not drawn to scale (shown larger than actual size) for clarity.
Figure 9:
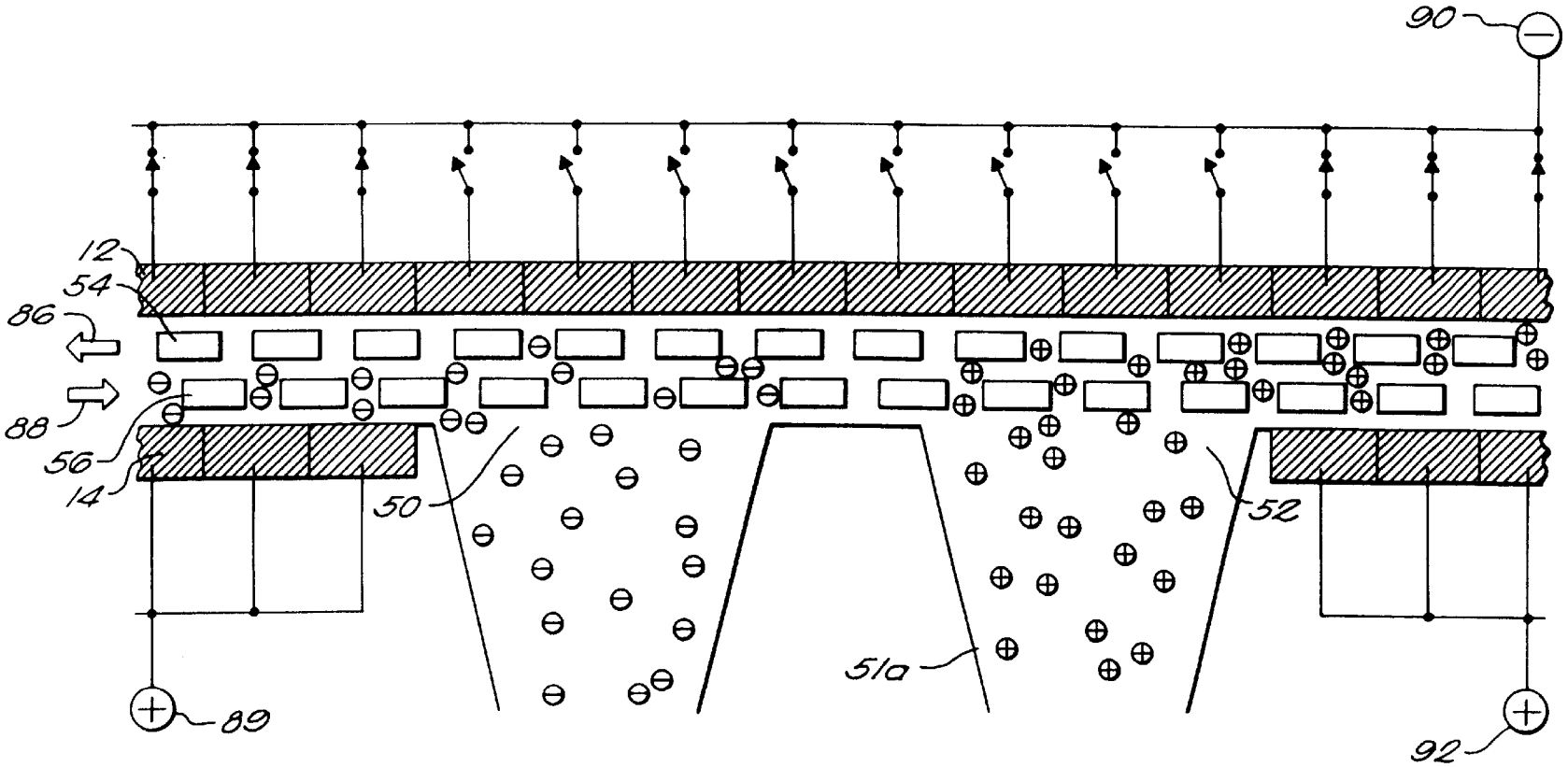
FIG. 9 is a partial cross-sectional view of the separator of FIG. 7 along the line BB' in the vicinity of the output ports, illustrating entry of the charged particles of opposite polarities into separate output ducts upon reaching the substantially field-free region in the vicinity of the output ports. The particles are not drawn to scale (shown larger than actual size) for clarity.

FIGS. 7, 8, and 9 illustrate an exemplary operation of the separator 10. A stream of particles 42 enter the separator 10 through the input duct 38 and the input port 48, as shown in FIG. 8, which is a top view of a portion of the separator enclosed within arrows 82 and 84 of FIG. 7, and herein referred to an input zone. For the purposes of this illustrative example, the agitator 54 is selected to rotate in a clockwise direction. Thus, as viewed from the top, a portion of the agitator 54 within the input zone moves in a direction shown by an arrow 86, i.e., to the left of the figure. The agitator 56 is selected to have a counter-clockwise rotation. Hence, a portion of the agitator 56 within the input zone, as viewed from the top, moves in a direction shown by an arrow 88, i.e., to the right of the figure. The electrodes of the upper field element array 12 are connected to a uniform negative electrical potential at a terminal 90, and the electrodes of the lower field element 14 are connected to a uniform positive electrical potential at a terminal 92. The choice of a negative or a positive electrical potential for the field element arrays 12 and 14 is arbitrary.

The inputted particles 42 are typically uncharged, i.e., they are in their normal, electrically neutral state, as they enter the separator 10. Mechanical agitation of the particles by the agitators 54 and 56, contact between the particles, and contact of the particles with the impellers 54 and 56, charge the inputted particles 42 either negatively or positively, depending on the triboelectric properties of the materials forming the particles. The charged particles drift under the attractive or repulsive influence of the electric field generated by the electrical potentials applied to the field element arrays 12 and 14 such that the positively charged particles tend to migrate and stratify in an upper region of the separation zone, i.e., within a stratum of air just below the upper field element array 12, and the negatively charged particles tend to migrate and stratify in a lower region of the separation zone, i.e., within a stratum of air just above the lower field element array 14. The rotation of the two agitators 54 and 56 keep these two strata of air in motion, with the upper stratum rotating clockwise, i.e., moving to the left as in the input zone as viewed from the top, and the lower stratum rotating counter-clockwise, i.e., moving to the right in the input zone as viewed from the top. The charged particles that are entrained in this air flow will also move to the left or the right. Hence, the agitators 54 and 56 impel the particles, in two streams, in two opposite directions.

FIG. 9 illustrates the particle stream 42 of FIG. 8 near the output ports 50 and 52 of the separator 10, and further illustrates portions of the upper and the lower field element arrays 12 and 14 in the vicinity of the input ports 50 and 52. A number of the electrodes of the upper field element array 12 located directly above the output ports 50 and 52 are not connected to the negative terminal 90, and generate no electric field. Hence, a separation zone in the vicinity of the output ports 50 and 54 is substantially field free. The rotating agitator 56 impels the negatively charged particles, stratified in the lower stratum of air by attractive and repulsive forces of the electric field between the upper and lower field element arrays 12 and 14, in a counter-clockwise fashion, i.e., from the left to the right in the figure, toward the output ports 50 and 52. When these negatively charged particles reach the output port 50, they are in a substantially field-free area, and hence are not constrained by electrical forces. Turbulent and shearing air forces move some of these particles upward into the flow moving in the opposite direction and move some downward into the output hopper 50. The particles moving downward can be removed from the separator by gravitational force and/or by a flow of air or other neutral gas that entrain these particles.

The rotating agitator 54 moves the positively charged particles, stratified in the upper stratum of air, in a clockwise motion, i.e., from right to left in the figure, toward the output port 52. Upon reaching the substantially field free region in the vicinity of the output port 52, the positively charged particles are no longer constrained by the electrical forces, and hence are free to move under the influence of turbulent and shearing air forces downward into the oppositely moving air flow. However, because there is no electric field in this oppositely moving air flow in the vicinity of the output 52, turbulent air forces as well as gravity induce a majority of these positively charged particles to fall though the output port 52, where they can be removed form the separator at an output hopper 52*a*.

Figure 10:
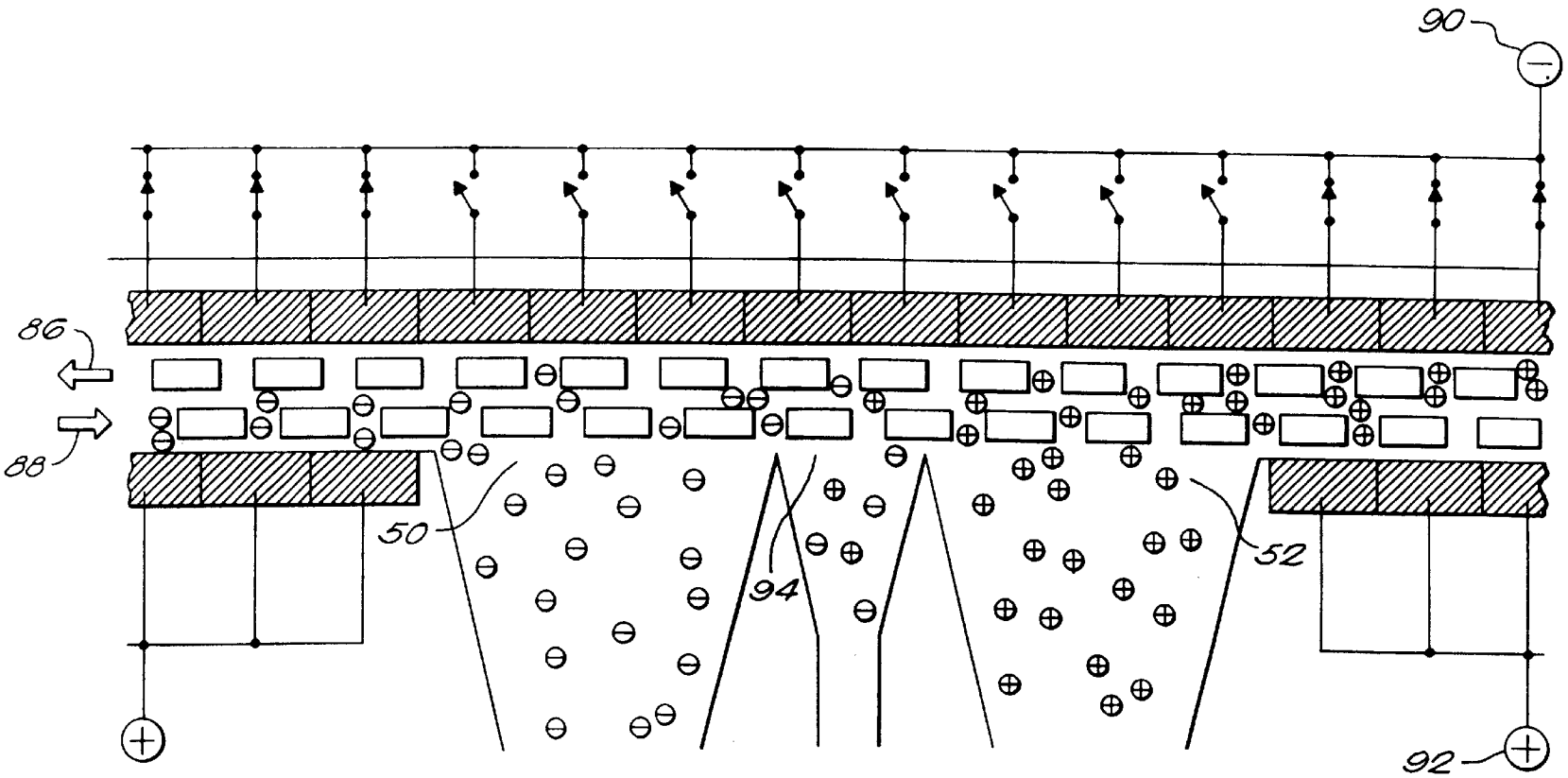
FIG. 10 is a partial cross-sectional view of an alternative separator according to the teachings of the invention having three output ports.

FIG. 10 illustrates another embodiment of the invention that modifies the separator 10 by including a third output port 94, located between the output ports 50 and 52, to enhance the efficiency, i.e., purity, of the separation process. In the separation process described in connection with FIG. 9, a relatively small portion of the particles may drift into the wrong output port. The intermediate output port 94 collects such particles, thereby preventing contamination of opposing particle stream. The intermediate output port 94 can be preferably connected to a source of negative pressure, i.e., a vacuum source, to enhance its collection efficiency. On preferred practice of the invention returns the mixed particles removed at the intermediate output port 94 back to the input port 48 (FIG. 1), for example through a duct (not shown), to enter the separator again. Thus, no material is lost through the intermediate output port 94.

Figure 11:
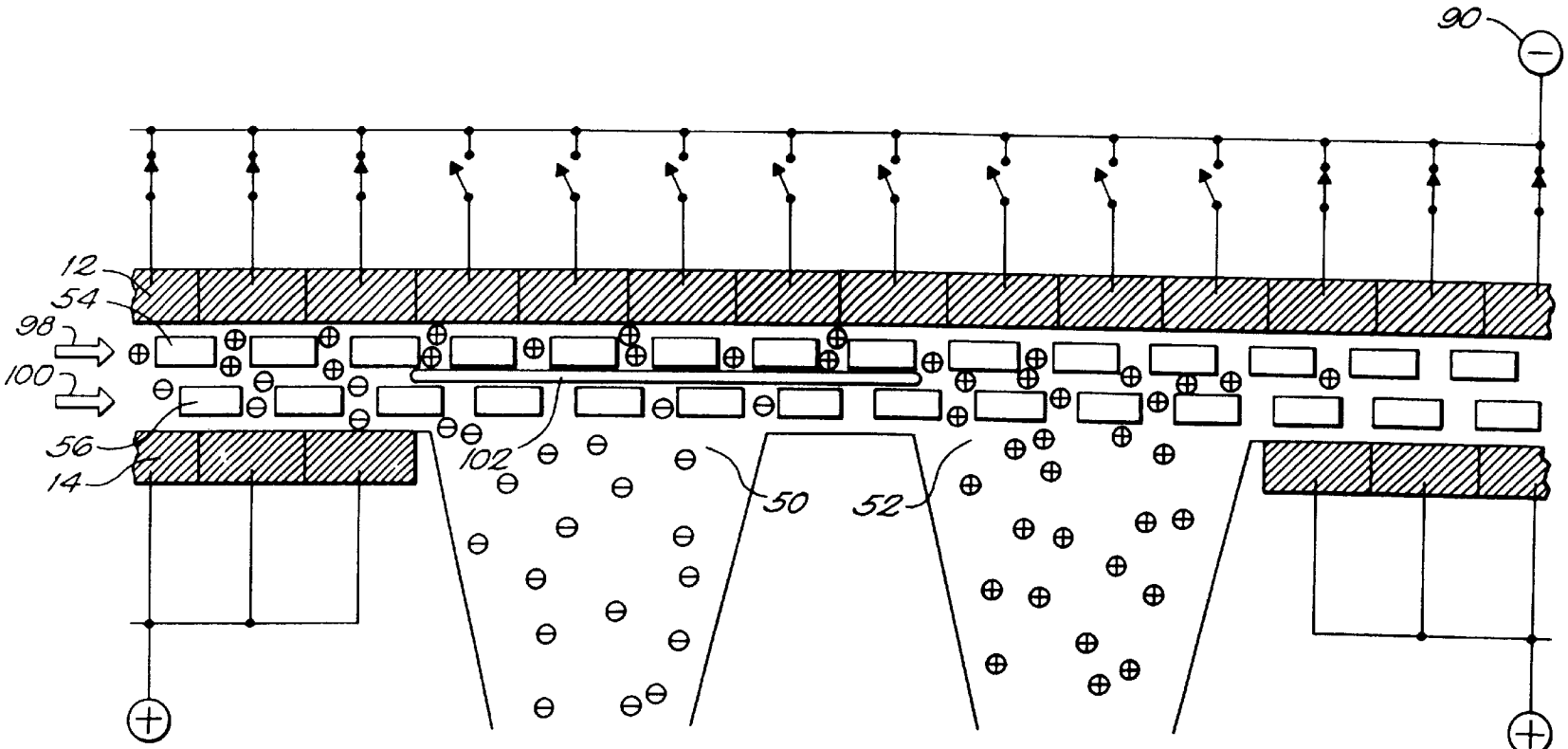
FIG. 11 is a partial cross-sectional view of an alternative separator according to the teachings of the invention configured for co-current operation, illustrating entry of the charged particles of opposite polarities into separate output ducts upon reaching the substantially field-free region in the vicinity of the output ports.

FIG. 11 illustrates a fragmentary cross-sectional view of a separator 1O*a* according to another embodiment of the invention that allows separation of a particle mixture in a co-current mode, i.e., in a mode where both agitators move in the same direction. In particular, FIG. 11 illustrates a top view of the agitators 54 and 56 in a region in the vicinity of the output ports 50 and 52, where both agitators are moving from left to right, i.e., counter-clockwise, as shown by arrows 98 and 100. As in the previous embodiment, the upper field element array 12 and the lower field element array 14 are held at opposite high electrical potentials, to produce an electric field in the separation region in order to stratify the particles streams as described previously. A fixed plate 102, interposed between the agitators 54 and 56, prevents mixing of the positively and the negatively charged particles upon entry into the substantially field-free region in the vicinity of the output ports 50 and 52. This allows the agitator 54 to move the positively charged particles past the output port 50 to a region above the output port 52, where the positively charged particles can fall into the output port 52. Hence, the positively and the negatively charged particles enter the output ports 50 and 52, respectively.

Figure 12:
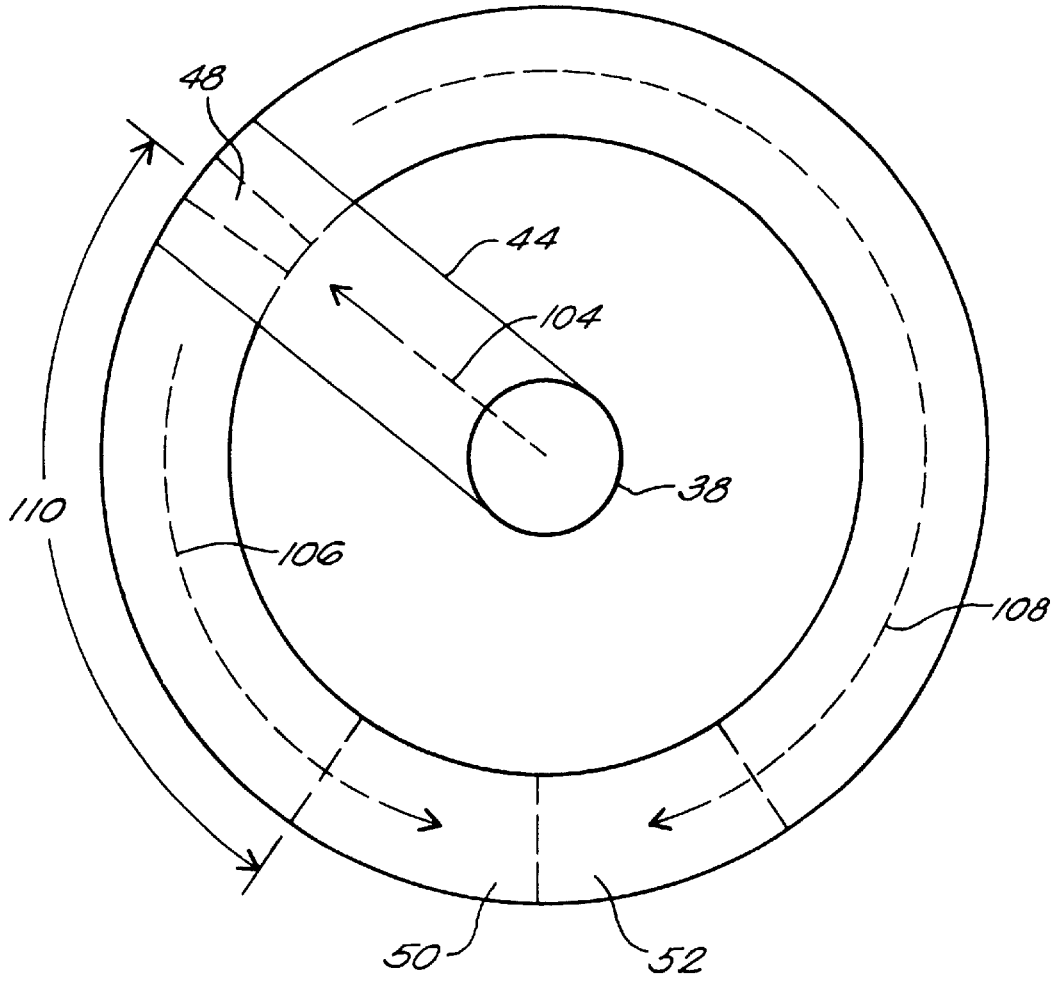
FIG. 12 is a top view of the separator of FIG. 4 (agitators not included for clarity) schematically illustrating the paths of the oppositely charged particles from the input zone to one of the output ports during a counter-current operation of the separator.

The operation of a separator according to the invention, such as the separator 10 discussed above, in a counter-current mode can be better understood by reference to FIG. 12. In particular, FIG. 12, which is a top schematic view of the current flow during operation of the separator 10 in a counter-current mode, illustrates that uncharged particles 42 enter the input hopper 38 and follow a path, designated by an arrow 104, from the input hopper 38 through the air slide 44 to the input port 48 to be inputted into the separator 10. As described above, upon entry into the separator 10, the uncharged particles are triboelectrically charged into positively and negatively charged particles, whose motions are depicted, respectively, by arrows 106 and 108. The output port 50 collects the positively charged particles and the output port 52 collects the negatively charged particles. The illustrated input hopper 38 is located on the central axis of the separator, which coincides with the rotational axis A of the agitators 54 and 56 (FIG. 1) and the upper field element 12. A rotational motion of the upper field element array 12, for example through an angle 110, causes a corresponding rotational motion of the air slide 44, and the input port 48, while the input hopper 38 remains centrally located. Hence, the illustrated separator 10 does not require any adjustment of the manner by which the particles are inputted into the hopper 38 as the input port 48 rotates. As the angle of rotation, i.e., the angle 110, varies, the path length of charged particles with one polarity, e.g., negative, shortens while the path length of the oppositely charged particles lengthens. Such adjustments of the path lengths of the particles advantageously allow controlling the purity versus yield characteristics of the separator 10. Because the rotation angle 110 can be varied continuously from zero to approximately 300 degrees in the illustrated separator 10, a large and continuously variable set of path lengths can be selected.

The rotation of the upper field element array 12 brings different electrodes 20 of the upper field array 12 to a region above the output ports 50 and 52. Because, as discussed above, the region above the output ports 50 and 52 must be substantially field free, the electrodes that lie above these ports must be disconnected from the high electrical potential applied to the other electrodes of the upper field element array. A preferred practice of the invention employs a plurality of sensors and switches, in a manner known in the art, to disconnect such electrodes, i.e., the electrodes that a rotation of the upper field element array 12 brings into a region above the output ports 50 and 52, from the source of high electrical potential.

The ability to vary the path lengths of the particles advantageously provides more flexibility in process adjustment than in conventional separators that include a small number of discrete, fixed input ports. For example, if the separator 10 is employed for removing crushed husk from flour after grinding the flour, one output port collects the husk material and the other collects the flour. The percentage of the husk material remaining in the flour is a measure of the purity of the separation process, whereas the percentage of the material being collected by the flour port is a measure of the yield of the separation process. If the input port is located close to the output port that collects the husk material, the flour mixed with the husk material will have a relatively short distance in which to be triboelectrically charged and electrostatically separated from the husk material. Thus, a relatively large portion of the flour enters the output port collecting the husk material, resulting in a low yield of the collected flour. The purity of the collected flour, however, will be good because the husk that does not enter the husk output port initially has sufficient time to be triboelectrically charged and separated from the flour. The movability of the input port 48 relative to the output ports 50 and 52 allows adjusting the position of the input port 48 to attain a desired level of purity and yield of the flour.

In applications in which the yield of the separation is more important than the purity, for example in separation of gold grains from quartz crystals, the input port 48 can be positioned distant from the output port collecting the waste material (quartz) and proximate the output port collecting the desired material (gold) to obtain a higher yield of gold. This arrangement provides greater opportunity for the waste material (quartz) to be separated from the desired material (gold) without a significant quantity of the desired material being collected in the waste output port.

FIG. 13 is a top schematic view of motion of the charged particles during operation of the separator 10*a* in a co-current mode. The input port 48 is rotated by a maximum angle 112 relative to the output port 50 to place the input port 48 adjacent the output port 52, thereby maximizing the path lengths of the charged particles of both polarities. The uncharged particles enter the separator 10*a* through the input port 48. Upon entering the separator 10*a,* the uncharged particles are triboelectrically charged, as describes above. The electric field between the upper and the lower field element arrays stratifies the charged particles, and the agitators (not shown) move the negatively and the positively charged particles counter-clockwise as depicted by arrows 114 and 116, respectively. The output port 50 collects the negatively charged particles, and the output port 52 collects the positively charged particles.

Although the separators discussed above, such as the separators 10 and 10*a,* have separation zones having planar annular geometries, those skilled in the art will understand that other geometries for the separation zone of a separator according to the present invention, such as cylindrical or drum-shaped geometries, are also possible. For example, FIG. 14 illustrates a separator 118 according to an alternative embodiment of the invention having a cylindrical geometry. The separator 118 includes a cylindrical inner field element array 120, a cylindrical outer field element array 122, a cylindrical inner agitator assembly 124, and a cylindrical outer agitator assembly 126, all arranged about a common axis of symmetry B. The separator 118 further includes an input duct 128 and two output ducts 130 and 132. The illustrated field element arrays 120 and 122 are formed of a plurality of electrodes, each insulated from the other, and arranged to form a cylindrical structure.

Whereas the illustrated field element arrays 120 and 122 are fixedly attached to a frame (not shown) of the separator 118, one or more motors (not shown) drive the inner and the outer agitator assemblies 124 and 126 rotationally in a substantially continuous manner about the common axis of rotation B. Similar to the agitators 54 and 56, described above in connection with FIG. 1, each agitator 124 or 126 includes two rings that serve as structural members and further provide drive points, and convenient bearing points. Further, each agitator 124 or 126 includes a plurality of transverse members, such as members 124*a,* which act as impellers.

The illustrated separator 118 has a length "L" and a diameter "D". Those skilled in the art will understand that different ratios of length over diameter, i.e., L/D, can be selected to produce separators that are suitable for different applications. For example, it is possible to have separators having cylinders with large diameters and small lengths or have cylinders with small diameters and large lengths.

Figure 15:
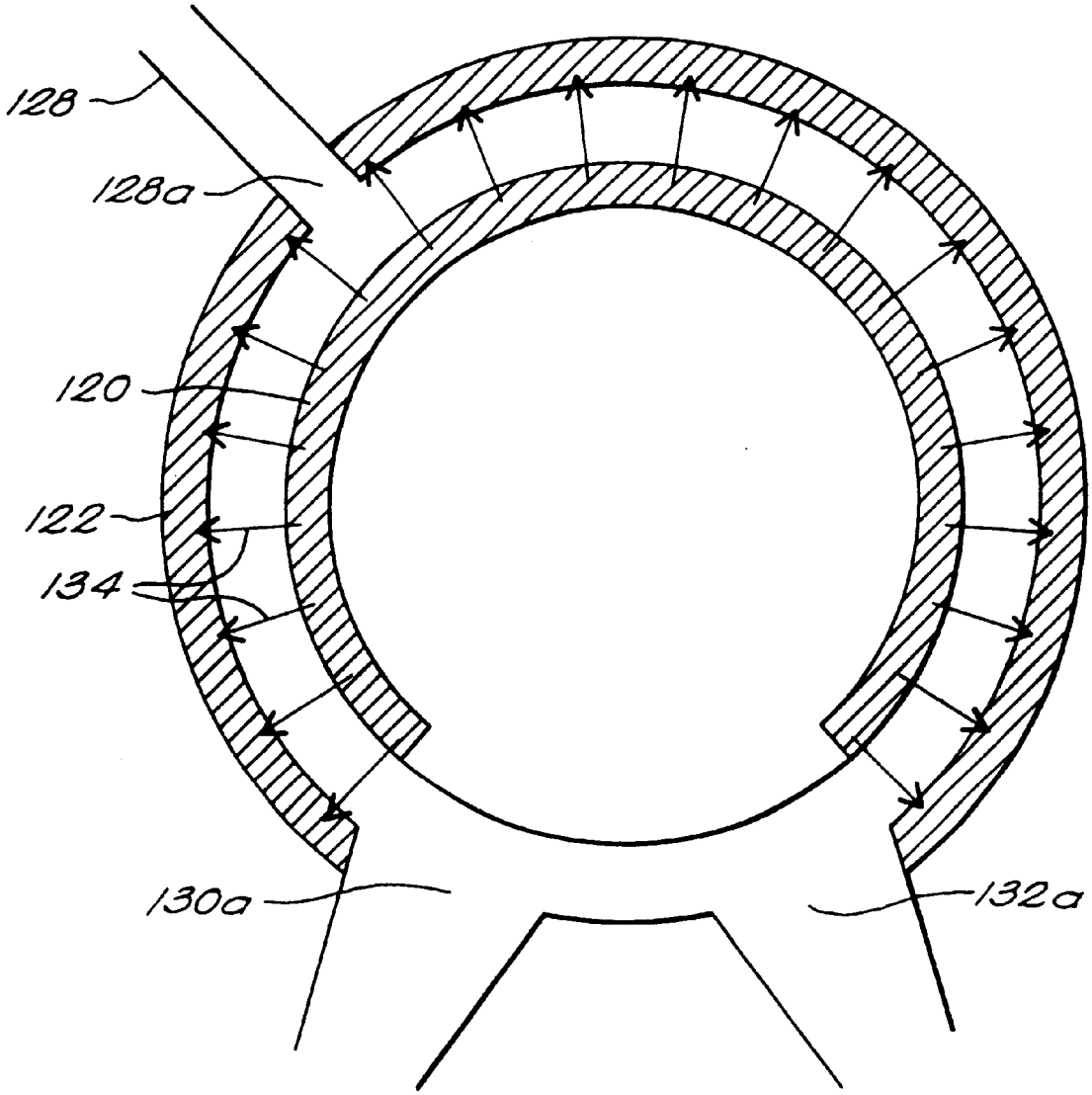
FIG. 15 is a cross-sectional view of the cylindrical separator of FIG. 14 along the line CC' (agitators not shown for clarity), illustrating the input duct and the output ducts and a plurality of representative electric field lines established between the outer and the inner cylindrical field element arrays.

FIG. 15, which is an end cross-sectional view of the separator 118, without the agitators 124 and 126, illustrates electric field lines 134, established between the outer cylindrical field element 122 and the inner cylindrical field element 120, by application of a high positive electrical potential to the field element 120 and a high negative electrical potential to the field element 122. The exemplary field lines 134 are shown to schematically illustrate approximate directions of electrical forces acting on the charged particles within the separator 118. Those skilled in the art will understand that the actual field lines typically deviate from the illustrated field lines 134. FIG. 15 further illustrates that the outer cylindrical field element 122 includes an input port 128*a* and two output ports 130*a* and 132*a*.

Figure 16:
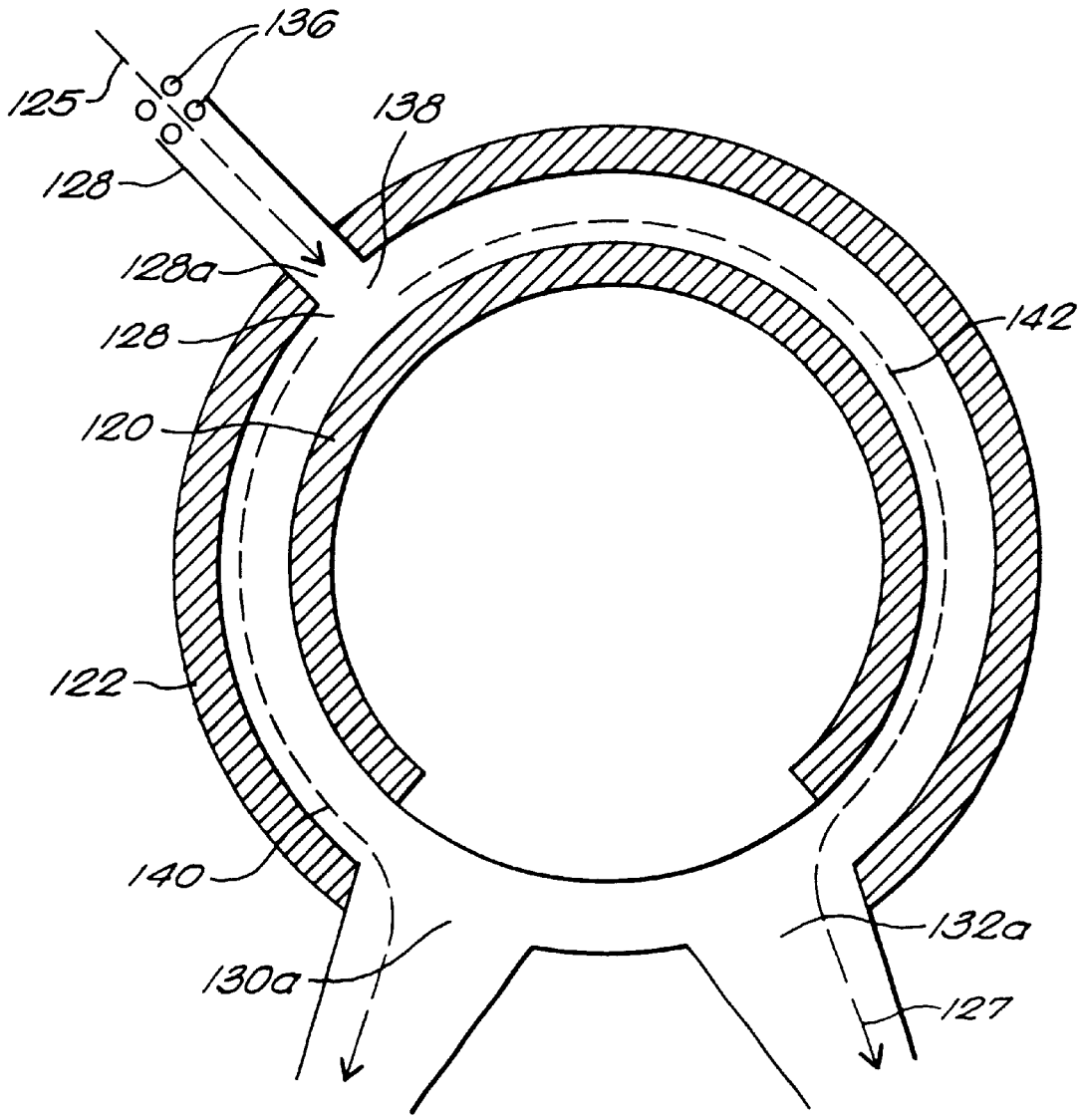
FIG. 16 is another cross-sectional view of the cylindrical separator of FIG. 14 (agitators not shown for clarity), schematically illustrating the path of particles inputted into the separator and the paths of the oppositely charged particles from the input zone to one of the two output ducts.

As shown in FIG. 16, a stream of mixed uncharged particles 136 enter a separation region 138 between the field elements 120 and 122 through the input port 128*a*. The agitator assemblies 124 and 128 (not shown) triboelectrically charge the inputted particles into positively and negatively charged particles. Under the influence of the agitators, particles of one charge polarity follow a path 140 and are extracted at the output port 130*a,* and particles of opposite charge polarity follow another path 142 to be extracted at the output port 132*a*.

Figure 17:
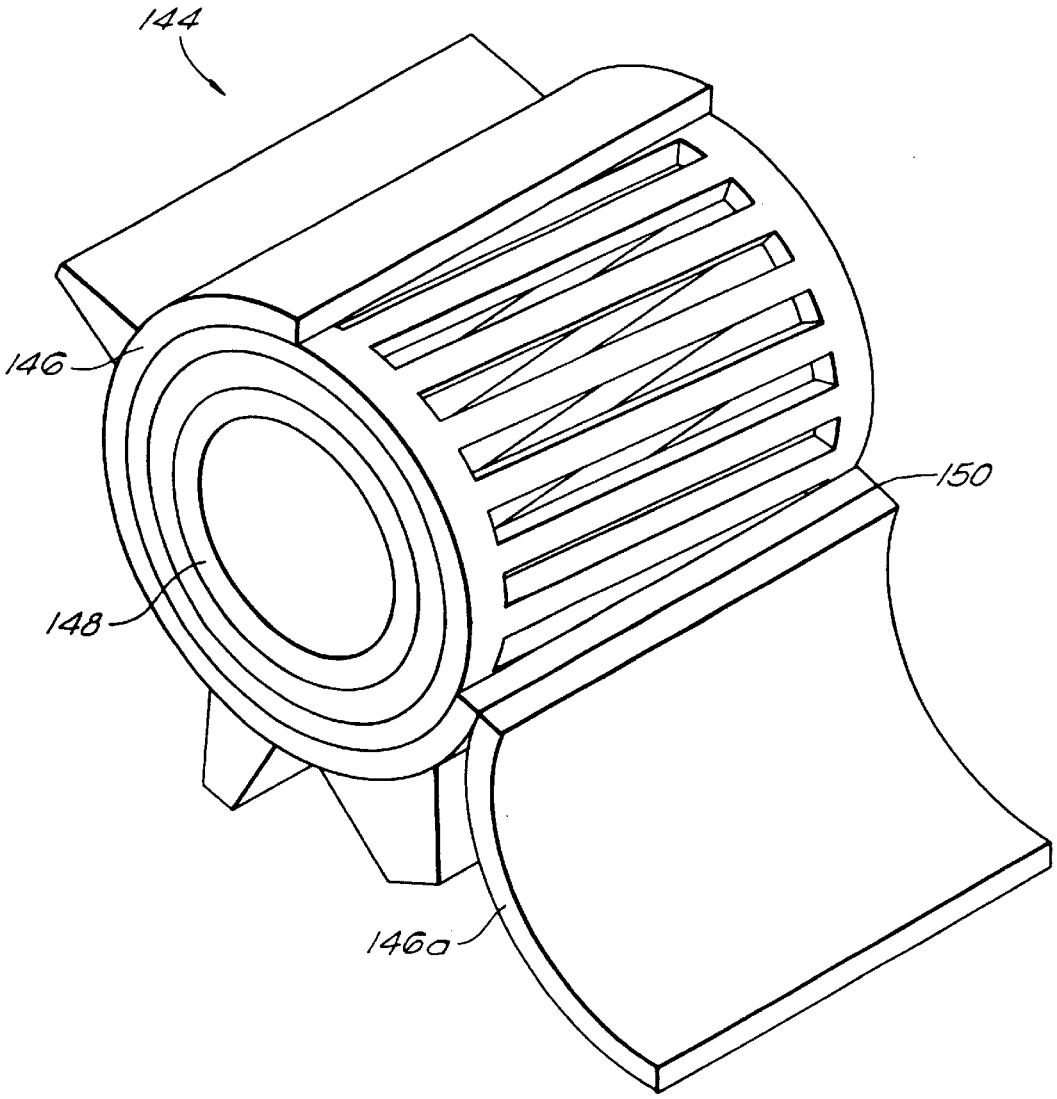
FIG. 17 is a perspective view of an alternative embodiment of a cylindrical separator according to the teachings of the present invention, which includes an outer cylindrical field element array having a portion configured to open on a hinge to provide access to the space between the inner and the outer field element arrays.

FIG. 17 illustrates another cylindrical separator 144 according to the invention. The separator 144 includes an outer cylindrical field element array 146 and an inner cylindrical field element array 148. Further, the outer field element array 146 includes a portion 146*a* configured to open on a hinge 148, to provide access to the space between the field element arrays 146 and 148. Such a structure advantageously eliminates the need for a mechanism for moving the cylinders axially to provide access to the inner structures of the separator 144, thereby lowering the time and the cost of construction of the separator 144, and rendering the maintenance of the separator 144 more convenient.

Figure 18:
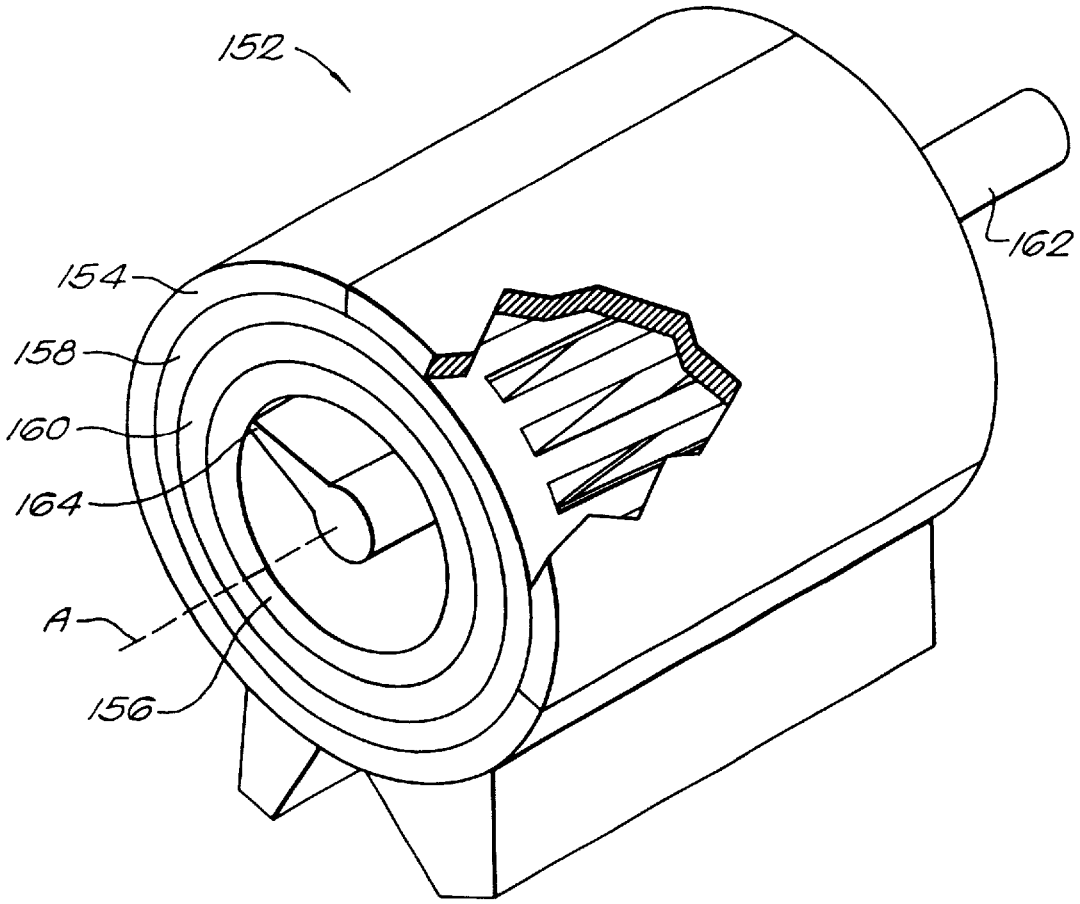
FIG. 18 is a perspective view of an alternative cylindrical separator according to the teachings of the present invention which includes an input port formed in the inner cylindrical field element array and an output duct extending along the cylindrical axis of the symmetry of the separator to the input port.

FIG. 18 illustrates a cylindrical separator 152 according to another embodiment of the invention that includes an outer field element array 154, an inner field element array 156 and two agitator assemblies 158 and 160. Further, the illustrated cylindrical separator 152 includes an input duct 162 that extends along an axis of symmetry A of the separator 152 and terminates at an input port 164. The inner field element array 156 is configured for rotation about the symmetry axis A to allow selected different pathlengths for the charged particles as they move within the separation zone of the separator 152.

Figure 19:
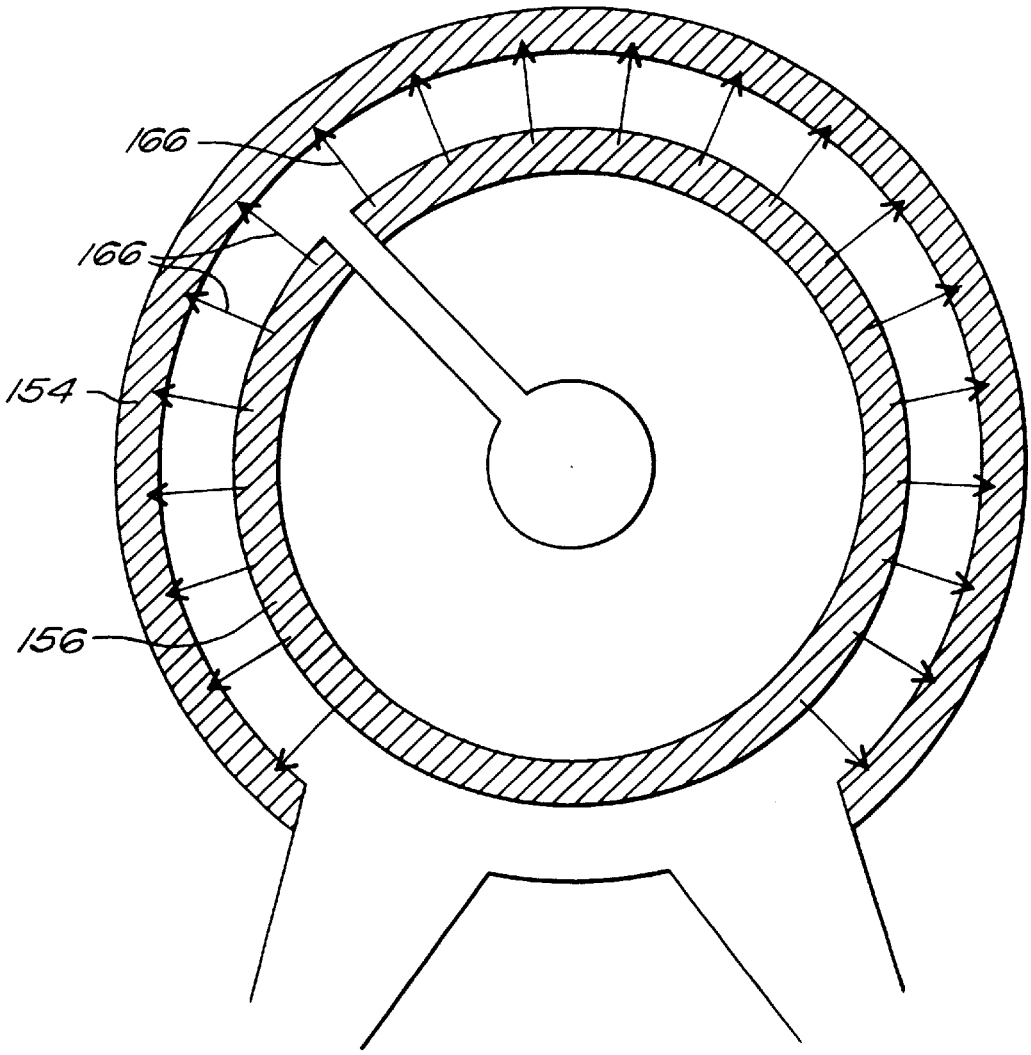
FIG. 19 is a cross-sectional view of the separator of FIG. 18 (agitators not shown for clarity) along the line DD', schematically illustrating a plurality of representative electric field lines established between the outer and the inner cylindrical field element arrays.

FIG. 19, a cross-sectional view of the field element arrays 154 and 156 of the separator 152, schematically illustrates a set of typical field lines 166 established by applying a positive potential to the field element array 156 and a negative potential to the field element array 154.

Figure 20:
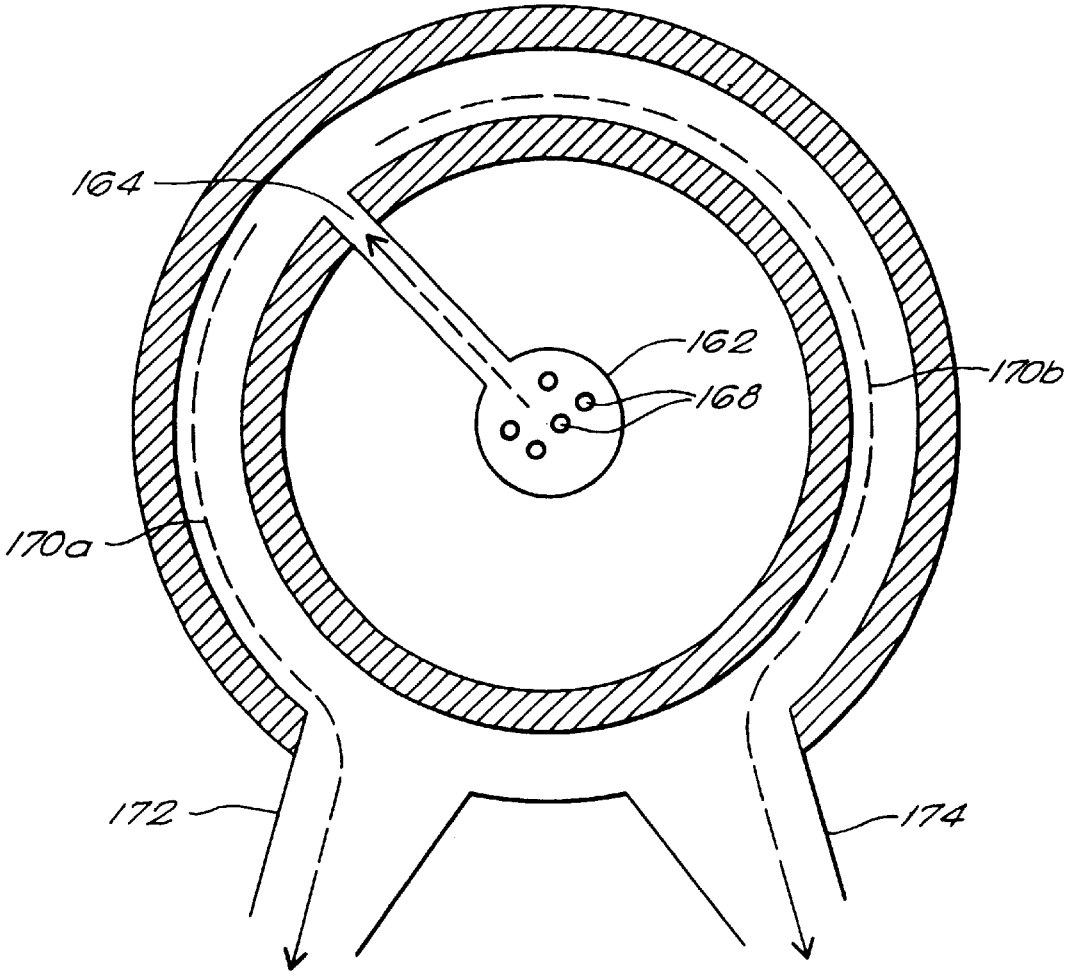
FIG. 20 is another cross-sectional view of the separator of FIG. 18 along the line DD' (agitators not shown for clarity), schematically illustrating the path of particles inputted into the separator through the input port, and the paths of oppositely charged particles from the input port to one of the output ports.

FIG. 20, another cross-sectional view of the separator 152 which for clarity does not show the agitators 158 and 160, illustrates that a stream of uncharged particles 168 are introduced through the duct 162 along a path 162*a* through the input port 164 into the space between the concentric field element arrays 154 and 156. As described above, the inputted particles are triboelectrically charged into positively and negatively charged particles. The charged particles of one polarity follow a path 170*a* into an output duct 172, and the charged particles of opposite polarity follow a separate path 170*b* into another output duct 174.

Figure 21:
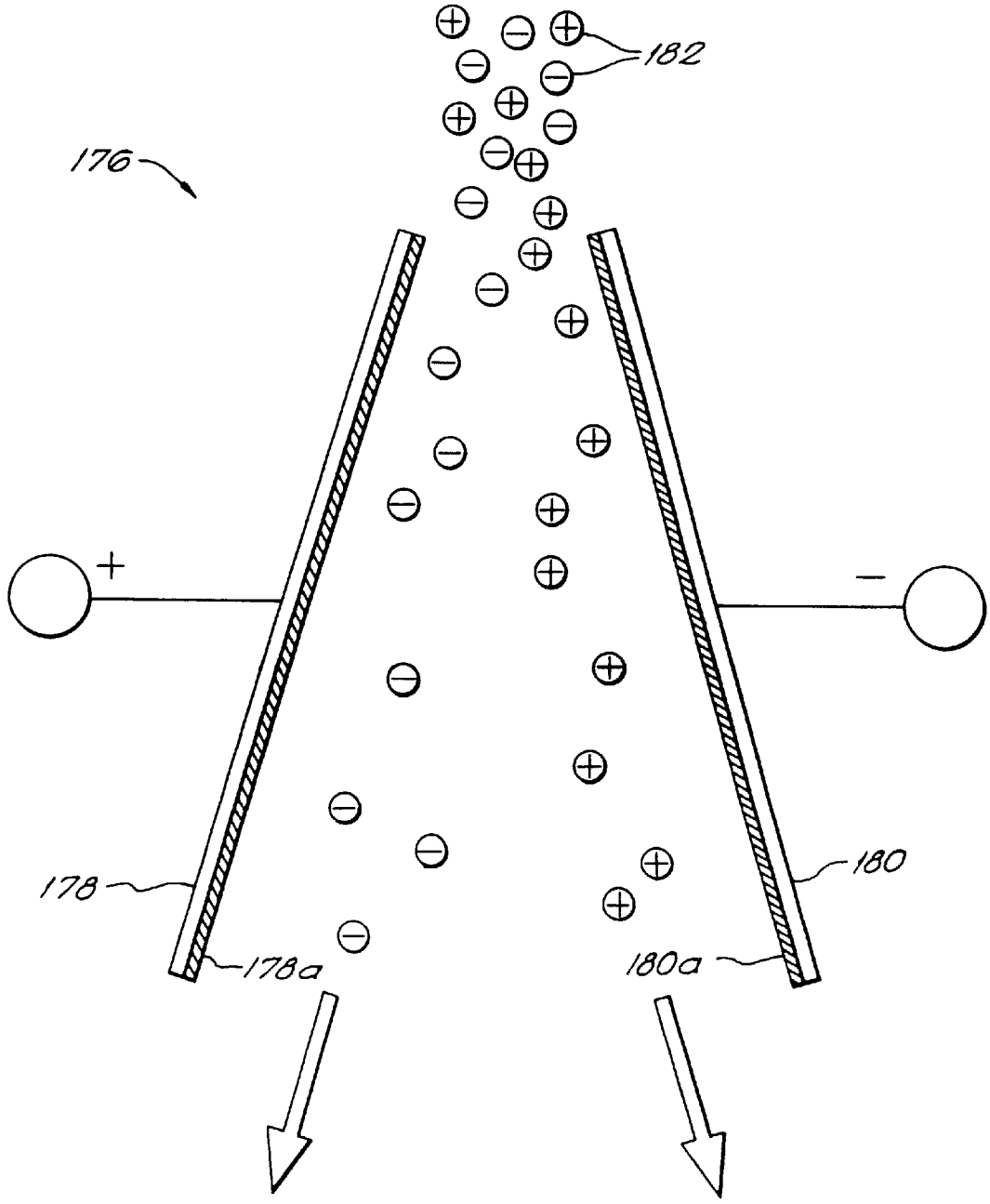
FIG. 21 is a cross-sectional view of a free-fall separator employing insulated electrodes according to the teachings of the present invention.

The use of insulated electrodes according to the teachings of the present invention for establishing an electric field within a separator is not limited to the above-described separators. Insulated electrodes according to the invention can also be employed in conventional separators, such as the electrostatic separator described in U.S. Pat. No. 4,839,032 and a free-fall separator. In particular, FIG. 21 illustrates a free-fall separator 176 that includes two electrodes 178, and 180. A positive electrical potential is applied to the electrode 178, and a negative electrical potential is applied to the electrode 180, to establish an electric field between the two electrodes. The electrodes 178 and 180 include insulating layers 178*a* and 180*a,* respectively, to insulate them from the particle mixture. The electrodes 178 and 180 can be formed by employing a conventional electrode on which a layer of insulating material, such as Kapton, is deposited. Alternatively, the electrodes 178 and 180 can have the same structure as that of the electrode 20*a*, described above in connection with FIG. 3.

In use, charged particles 182 are introduced into the space between the electrodes 178 and 180 from the top, and are allowed to fall between the two electrodes 178 and 180. The particles typically acquire their charge through normal material handling processes. As the charged particles move through the field established between the electrodes 178 and 180, the negatively charged particles are deflected toward the positive electrode 178 and the positively charged particles are deflected toward the negative electrode 180. Hence, the oppositely charged particles are separated after travelling through the space between the two electrodes 178 and 180, and can be separately collected.

The insulated layers 178*a* and 180*a* advantageously allow application of higher electrical potentials to the electrodes 178 and 180 than those that can be applied to conventional uninsulated electrodes. The higher electrical potentials lead to establishing a stronger electric field between the electrodes, which in turn improves the separation of the charged particles.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed new and protected by Letters Patent follows:

1. An apparatus for separating the particles of a mixture, said apparatus comprising at least two spaced-apart field element arrays establishing a field in the space between said arrays, an input for introducing said mixture into the space between said field elements, and two oppositely rotating agitators operating in the space between said field elements and agitating said particles of said mixture to triboelectrically charge said particles to one of two charge polarities, said charged particles having one polarity substantially accumulating in the vicinity of one of said field elements and said particles having the opposite polarity substantially accumulating in the vicinity of the other field element to separate the particles of the mixture.

2. The apparatus of claim 1, wherein said field comprises an electric field.

3. The apparatus of claim 1, wherein said field element arrays comprise annular electrodes.

4. The apparatus of claim 1, wherein at least one of said field element arrays comprises a plurality of electrodes arranged to form an annular disk, said electrodes being insulated from each other by a plurality of non-conducting tiles.

5. The apparatus of claim 4, wherein said non-conducting tiles are formed of material having a high breakdown voltage.

6. The apparatus of claim 5, wherein said material having a high break down voltage comprises a Kapton film.

7. The apparatus of claim 4, wherein different electric potentials are applied to said electrodes to produce a spatially varying field in the space between said field elements.

8. The apparatus of claim 4, wherein each of said electrodes of each field element array includes an insulating layer for insulating said electrode from the opposed field element array and from the particles of the mixture.

9. The apparatus of claim 4, wherein each of said electrodes comprises a mechanical substrate, a conductor having first and second opposed surfaces, said first surface being bonded to said mechanical substrate, a high-voltage connector in electrical contact with said conductor to permit application of an electrical potential to said conductor, and an insulating layer covering said second surface of said conductor to electrically insulate said conductor.

10. The apparatus of claim 9, wherein said conductor is metallic.

11. The apparatus of claim 9, wherein said conductor is formed of graphite.

12. The apparatus of claim 9, further comprising a wear strip covering said insulating layer to provide mechanical protection for said layer.

13. The apparatus of claim 12, further comprising at least one non-conducting insert to provide tie points for attaching said electrode to a selected mechanical structure.

14. The apparatus of claim 9, further comprising a conductor partially enclosing said electrode to provide a ground plate.

15. The apparatus of claim 1, wherein said agitators rotate about a common rotation axis.

16. The apparatus of claim 15, wherein said rotation axis is parallel to the direction of said field.

17. The apparatus of claim 1, wherein said agitators include a plurality of openings therein to allow passage of the particles of the mixture therethrough.

18. The apparatus of claim 17, wherein the agitators rotate about a common rotation axis, and the openings in one of said two agitators extend at a first angle with respect to said common rotation axis that is different from a second angle at which the openings in the other agitator extend.

19. The apparatus of claim 1, wherein each of said two agitators includes two rings and a plurality of transverse members extending between said two rings, said transverse members being skewed from a radial orientation to impart an inward radial momentum to air within said separator.

20. The apparatus of claim 1, wherein said agitators are annular disks.

21. The apparatus of claim 1, wherein said agitators are formed of a non-conducting material.

22. The apparatus of claim 21, wherein said non-conducting material comprises plastic.

23. The apparatus of claim 21, wherein said non-conducting material comprises ceramic.

24. The apparatus of claim 21, wherein said non-conducting material comprises plastic-ceramic composites.

25. The apparatus of claim 21, wherein said non-conducting material comprises Teflon.

26. The apparatus of claim 1, wherein said input comprises an input port formed in one of said field element arrays, said input port being movable about said field element array to introduce said mixture of particles at different locations into the space between said field element arrays.

27. The apparatus of claim 1, further comprising an output for collecting said separated particles of the mixture.

28. The apparatus of claim 27, wherein said output comprises two ports coupled to one of said field element arrays, said ports being substantially field free to allow said particles to collect in said ports, each of said ports collecting said charged particles having one of said charge polarities.

29. An apparatus for separating the particles of a mixture, said apparatus comprising an outer and an inner spaced-apart cylindrical coaxial field element arrays, said inner field element array being disposed within said outer field element array to establish a field in the space between said arrays, an input for introducing said particles of the mixture into the space between said arrays, and two counter-rotating cylindrical agitators operating in the space between said field element arrays and agitating said particles of said mixture to triboelectrically charge said particles to one of two charge polarities, said charged particles having one polarity accumulating substantially in the proximity of one of said field element arrays and said particles having the opposite polarity accumulating substantially in the proximity of the other field element array, thereby separating the particles of the mixture.

30. The apparatus of claim 29, wherein said field comprises an electric field.

31. The apparatus of claim 30, wherein time-varying electric potentials are applied to said field element arrays to produce a time-varying electric field in the space between said field elements.

32. The apparatus of claim 29, wherein said field element arrays comprise a plurality of electrodes.

33. The apparatus of claim 29, wherein at least one of said field element arrays is constructed of a plurality of electrodes axially disposed to form a cylindrical surface, said electrodes being insulated from each other by a plurality of non-conducting tiles axially disposed between said conducting tiles.

34. The apparatus of claim 33, wherein said non-conducting tiles include a Kapton film.

35. The apparatus of claim 29, wherein said agitators include a plurality of openings formed therein to permit passage of said particles therethrough.

36. The apparatus of claim 29, wherein said agitators are constructed of a non-conducting material.

37. The apparatus of claim 36, wherein said non-conducting material comprises plastic.

38. The apparatus of claim 36, wherein said non-conducting material comprises ceramic.

39. The apparatus of claim 36, wherein said non-conducting material comprises plastic-ceramic composites.

40. The apparatus of claim 36, wherein said non-conducting material comprises Teflon.

41. The apparatus of claim 29, wherein the rate of rotation of one of said agitators differs from the rate of rotation of the other agitator.

42. The apparatus of claim 29, wherein said input comprises an input port formed in one of said field element arrays, said input port being movable about said field element array to input said mixture at different positions within the space between said field elements.

43. The apparatus of claim 42, wherein said input port is formed on said inner field element array.

44. The apparatus of claim 29, further comprising an output for collecting said separated particles.

45. The apparatus of claim 44, wherein said output comprises two ports formed in one of said field element arrays, said ports being substantially field free to allow said particles to collect in said ports, each of said ports collecting said charged particles having one of said charge polarities.

46. An apparatus for separating the particles of a mixture, said apparatus comprising two spaced-apart annular field element arrays for establishing a field in the space between said arrays, an input for introducing said particles of the mixture into the space between said element arrays, two spaced-apart counter-rotating annular agitators operating in the space between said field element arrays, said agitators having a plurality of openings therein to allow passage of the particles of the mixture therethrough, said agitators agitating said particles of said mixture to triboelectrically charge said particles to one of two charge polarities, said charged particles having one polarity substantially accumulating in the vicinity of one of said field element arrays and said particles having the opposite polarity substantially accumulating in the vicinity of the other field element array to separate the particles of the mixture, and an output having two ports for collecting said separated particles, one of said ports collecting said particles having one charge polarity and the other of said ports collecting said particles having the opposite charge polarity.

47. An apparatus for separating the particles of a mixture, comprising two spaced-apart annular field element arrays for establishing an electric field in the space between said arrays, an input port for introducing said particles of the mixture into the space between said field elements, two spaced-apart annular agitators configured for rotating in the space between said two field elements, said agitators having a plurality of openings therein to allow passage of the particles of the mixture therethrough, said agitators agitating said particles of said mixture to triboelectrically charge said particles to one of two charge polarities, said charged particles having one polarity substantially accumulating in the vicinity of one of said field elements and said particles having the opposite polarity substantially accumulating in the vicinity of the other field element to separate the particles of the mixture, first and second output ports for collecting said separated particles, one of said ports collecting said particles having one charge polarity and the other of said ports collecting said particles having the opposite charge polarity, and a plate disposed in the space between said agitators and extending substantially over said first output port so as to prevent entry of said particles having one of said charge polarities into said first output port.

48. An apparatus for separating the particles of a mixture, said apparatus comprising two annular spaced-apart field element arrays establishing a field in the space between said field element arrays, an input port for introducing said mixture into the space between said field element arrays, and two agitators rotatably operating in the space between said field elements and agitating said particles of said mixture to triboelectrically charge said particles to one of two charge polarities, each of said agitators having a ring and a plurality of impellers cantilevered from said ring, said charged particles having one polarity substantially accumulating in the vicinity of one of said field element arrays and said particles having the opposite polarity substantially accumulating in the vicinity of the other field element array to separate the particles of the mixture.

49. A method for separating the particles of a mixture, said method comprising the steps of providing at least two spaced-apart field element arrays, establishing a field in the space between the field element arrays, introducing the mixture into the space between the field element arrays, and agitating the particles of the mixture to triboelectrically charge the particles to one of two charge polarities, said particles having one charge polarity substantially accumulating in one region of the space between the field element arrays and the particles having the opposite charge polarity substantially accumulating in a separate region of the space.

50. The method of claim 49, wherein said step of agitating includes providing at least two spaced-apart agitators operable in said space between said electrodes.

51. The method of claim 49, further comprising the step of providing an output in a field free portion of said volume for collecting said separated particles.

52. The method of claim 49, wherein said output comprises two ports, one of said ports collecting said particles having one charge polarity and the other of said ports collecting said particles having the opposite charge polarity.

53. The method of claim 49, wherein said step of agitating includes the steps of rotating a portion of the particles in a first direction, and rotating a portion of the particles in a second direction opposite to the first direction.

* * * * *